US006369777B1

(12) United States Patent
Ohara et al.

(10) Patent No.: US 6,369,777 B1
(45) Date of Patent: Apr. 9, 2002

(54) ANTENNA DEVICE AND METHOD FOR MANUFACTURING THE SAME

(75) Inventors: Masahiro Ohara, Katano; Koji Sako, Okayama; Shinzo Koumoto, Tsuyama; Yusuke Ishito, Okayama; Yasunori Kishimoto; Norihisa Nishida, both of Tsuyama; Hiroaki Tsuda, Okayama, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/787,936

(22) PCT Filed: Jul. 21, 2000

(86) PCT No.: PCT/JP00/04867

§ 371 Date: May 22, 2001

§ 102(e) Date: May 22, 2001

(87) PCT Pub. No.: WO01/08256

PCT Pub. Date: Feb. 1, 2001

(30) Foreign Application Priority Data

Jul. 23, 1999 (JP) ..... 11-208627

(51) Int. Cl.[7] ..... H01Q 1/36

(52) U.S. Cl. ..... 343/895; 343/702; 343/872; 343/893

(58) Field of Search ..... 343/702, 725, 343/872, 873, 895, 893, 906

(56) References Cited

U.S. PATENT DOCUMENTS 4,730,195 A * 3/1988 Phillips et al. ..... 343/792
5,910,790 A 6/1999 Ohmuro et al. ..... 343/895
6,075,488 A * 6/2000 Hope ..... 343/702
6,112,102 A * 8/2000 Zhinong ..... 455/550
6,127,979 A * 10/2000 Zhou et al. ..... 343/702
6,137,452 A * 10/2000 Sullivan ..... 343/873
6,163,300 A * 12/2000 Ishikawa et al. ..... 343/702
6,198,442 B1 * 3/2001 Rutkowski et al. ..... 343/702
6,204,826 B1 * 3/2001 Rutkowski et al. ..... 343/895
6,232,930 B1 * 5/2001 Faulkner ..... 343/895
6,278,415 B1 * 8/2001 Matsuyoshi et al. ..... 343/895

FOREIGN PATENT DOCUMENTS

JP 3-253009 11/1991
JP 7-7112 1/1995
JP 409083238 A * 3/1997 ..... H01Q/9/28
JP 11-41025 2/1999

* cited by examiner

*Primary Examiner*—Don Wong
*Assistant Examiner*—Shih-Chao Chen
(74) *Attorney, Agent, or Firm*—Ratner & Prestia

(57) ABSTRACT

Relating to an antenna device used in wireless unit for mobile communication or the like, it is an object to present an antenna device hardly causing uneven pitch or deformation of antenna elements, high in gain and reliability, excellent in productivity, and having two or more impedance characteristics, and a method of manufacturing the same. Both ends of plural bands (16) are alternately connected consecutively, both ends of plural bands (18) are alternately connected consecutively in a first antenna element (11) made of a thin metal plate of nearly circular spiral form projecting alternately in the longitudinal direction, a second antenna element (12) made of a thin metal plate formed by projecting in a nearly semicircular tubular form in the front direction is disposed at a nearly concentrical position, a mounting bracket (13) is connected to one end of the first antenna element (11), and the outer circumference of the members is covered with a cover (15) made of an insulating resin, thereby composing an antenna device.

25 Claims, 27 Drawing Sheets

ANTENNA DEVICE AND METHOD FOR MANUFACTURING THE SAME

This Application is a U.S. National Phase Application of PCT International Application PCT/JP00/04867.

TECHNICAL FIELD

The present invention relates to an antenna device mainly used in wireless unit for mobile communication or the like, and a method of manufacturing the same.

BACKGROUND ART

Recently there is a rapidly increasing demand for wireless unit for mobile communication such as cellular phone. The wireless unit is diversified in function so as to transmit and receive more information by one unit. To meet such demand for multiple functions, a wireless unit capable of transmitting and receiving radio waves in plural frequency bands is developed. To cope with plural frequencies, the wireless unit has an antenna setting two or more impedance characteristics.

As the antenna applicable to plural frequency bands, the helical antenna with coil winding is widely used.

A conventional antenna is explained by referring to FIG. 28.

FIG. 28 is a sectional view of a conventional antenna device applicable to two frequency bands. As shown in FIG. 28, a conventional antenna device 6 comprises:

a) a first helical antenna element (HAE) 1 made of copper wire or copper alloy wire, b) a second HAE 4 made of copper wire or copper alloy wire, c) a core 3 made of insulating resin for winding the HAE 1 and HAE 4 while insulating the HAE 1 and HAE 4, d) a mounting bracket 2 made of metal for mounting the core 3 on which the HAE 1 and HAE 4 are wound, and further mounting on the wireless unit, and e) an insulating cover 5 for covering the outer circumference of the HAE 1, HAE 4, and core 3.

The HAE 1 includes an upward coil winding 1A, and a junction 1B for electrically connecting to the mounting bracket 2. The mounting bracket 2 has a circular recess 2A for fitting the lower end of the core 3. The winding 1A of the HAE 1 is wound around the core 3 which is fixed to the recess 2A. The junction 1B at the lower end of the HAE 1 is electrically connected to the recess 2A of the mounting bracket 2. The winding diameter and winding pitch of the HAE 1 are same as the winding diameter and winding pitch of the HAE 4. In the winding pitch of the winding 1A of the HAE 1, the HAE 4 is wound. As a result, the HAE 1 and HAE 4 are mutually insulated. The HAE 4 is parasitic, and is insulated from the mounting bracket 2. An insulating cover 5 is formed by insert molding of insulating resin on the outer circumference of the core 3 on which the HAE 1 and HAE 4 are wound.

In the antenna device 6 thus composed, when sending and receiving radio waves, an electric current is induced between the windings of the HAE 1 and HAE 4 by electromagnetic inductive action. Making use of the induced current, the wireless unit having the antenna 6 can send and receive radio waves in at least two frequency bands.

The configuration of the HAE 1 and parasitic HA 4 requires high precision so as not to contact with each other and to maintain the desired antenna characteristic. In the conventional antenna 6, however, the winding may be uneven in pitch or may be deformed when winding the copper wire or copper alloy wire on the core 3 and covering with the insulating resin 5. Therefore, in the conventional antenna device having such structure, it is hard to obtain an impedance characteristic corresponding to a desired frequency band. That is, in the gain of the conventional antenna device, fluctuations were large. Accordingly, in order to obtain an antenna having a desired characteristic, it was necessary to sort out. There was also a limit for enhancing the yield of the conventional antenna device. In the conventional antenna device, therefore, reduction of cost was limited by the sorting process and the yield.

SUMMARY OF THE INVENTION

The invention relates to an antenna device having two or more impedance characteristics capable of solving the problems of the conventional antenna device. It is hence an object of the invention to present an antenna device hardly causing uneven pitch or deformation of antenna elements, stable in gain, and high in reliability. It is also an object of the invention to present a method of manufacturing antenna devices excellent in productivity.

To achieve the object, the antenna device of the invention comprises:

a) a first antenna element (FAE) of spiral form having nearly parallel plural bands formed so that both ends may be connected alternately and consecutively, and formed so that at least one or more bands may be projected, b) a second antenna element (SAE) of meandering form having nearly parallel plural bands formed so that both ends may be connected alternately and consecutively, and formed so that at least one or more bands may be projected, c) a core made of an insulating resin for disposing the FAE and SAE nearly at concentrical positions, d) a mounting bracket connected to one end of the FAE, and e) a cover made of an insulating resin for covering the outer circumference of each member, by exposing a part of the mounting bracket.

The FAE and SAE are formed by pressing a conductive thin metal plate punched in a specified shape into a desired shape. In order that the FAE and SAE may be mutually insulated, each inner side is fixed to the core. One end of the FAE is electrically connected to the mounting bracket. The mounting bracket has a threaded portion for mounting on a wireless unit for mobile communication such as cellular phone. The threaded portion is exposed.

Thus is presented an antenna device hardly causing uneven pitch or deformation of the antenna elements during manufacture, and having two or more impedance characteristics. It is high in reliability because uneven pitch or deformation hardly occurs.

Moreover, the antenna device having such structure can be produced easily, and the product yield is high.

The invention also provides a method of manufacturing antenna device which comprises:

a) a step of forming a first element plate by a step of punching a conductive thin metal plate of a specified dimension, and a step of pressing a part of the punched thin metal plate, b) a step of forming a second element plate by a step of punching a conductive thin metal plate of a nearly same dimension as the first element plate, and a step of pressing a part of the punched thin metal plate, c) a step of stacking up the outer circumferential parts of the first element plate and second element plate in the thickness direction, d) a step of primary insert molding of a resin dielectric element for forming a core having a plurality of resin support parts by fixing the pressed portion of the stacked first element plate and the pressed portion of the second element plate, e) a step of separating the core from the outer circumference by cutting off the flat outer circumferential parts of the pressed portion of the first element plate and the pressed portion of the second element plate near the core, and f) a step of secondary insert molding of a resin dielectric element for forming a cover for covering the outer circumference by holding the resin support parts.

In the step of forming the first element plate of the invention, a conductive thin metal plate of a specified dimension is blanked, and nearly parallel plural rectangular holes of same length are provided so that both ends may be convex and concave alternately, thereby forming plural linear portions, one side of convex and concave portion of the plural rectangular holes is separated from the outer circumferential part in a linked state, a band is formed by pressing at least a part of the linear portion of the plural linear portions, the band is formed so as to be coupled to the outer circumference at the other side, and a mounting bracket is connected and fixed to one end of the band, thereby forming a first element plate.

In the step of forming the second element plate of the invention, a conductive thin metal plate is blanked, and nearly parallel plural hook holes of same length are provided alternately in reverse directions, so that plural linear portions are linked in a thin linkage alternately right and left, one side of the plural hook holes is separated from an outer frame in a linked state, a band is formed by pressing at least a part of linear portion of the plural linear portions, and other side of the band is coupled to the outer circumference, thereby forming a second element plate.

In the primary insert molding step of the invention, outer circumferential parts of the first element plate and second element plate are held, an insulating resin is processed by insert molding, the band of the first element plate and the band of the second element plate are fixed by resin from the inner side by this insert molding, the mounting bracket is coupled, and a core having a plurality of resin support parts projecting by a specified dimension from the outer circumference of the band of the first element plate and the band of the second element plate is formed.

In the step of separating the core from the outer circumference of the invention, the core is separated from the outer circumference by cutting off near the core coupled to the outer circumference of the first element plate and second element plate, and the convex and concave linked portion at the end of the plural slots and the thin linkage are separated.

By this separation, an FAE is formed from the first element plate and an SAE is formed from the second element plate.

In the step of secondary insert molding of a resin dielectric element of the invention, the FAE and SAE formed in the above step, and the core are molded and processed by an insulating resin, while holding the mounting bracket and the resin support parts, and a part of the mounting bracket is exposed, and a cover for covering the outer circumference of the FAE and SAE is formed.

In the antenna device by the manufacturing method of the invention, uneven pitch or deformation of antenna elements hardly occur during manufacture, and the antenna device having two or more impedance characteristics is obtained. Moreover, since uneven pitch or deformation hardly occurs, the reliability is high.

According to the manufacturing method of the invention, the antenna device can be produced easily, and the product yield is high.

The antenna device of the invention can be used in wireless unit for mobile communication or the like, personal computer, transceiver, professional communication for example, taxi, fishing boat, police), and other wireless unit for wireless communication.

BEST MODE FOR CARRYING OUT THE INVENTION

Figure 1:
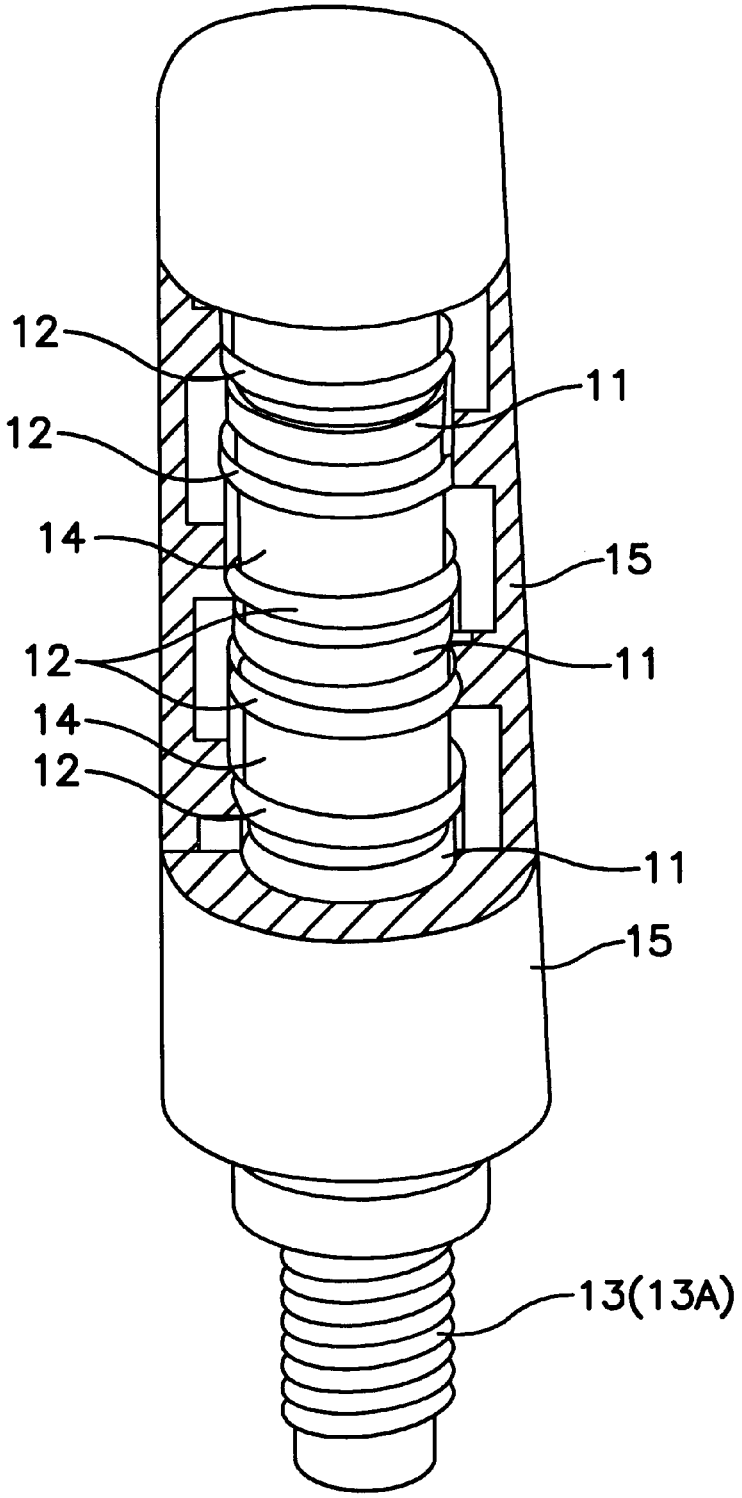
FIG. 1 is a perspective view of partial section of an antenna device according to a first embodiment of the invention.

Referring now to the drawings, preferred embodiments of the invention are described in detail below.

Embodiment 1

FIG. 1 is a perspective view of partial section o an antenna device according to a first embodiment of the invention.

The antenna device shown in FIG. 1 comprises:

a) an FAE 11 formed in a nearly circular spiral form by punching and pressing a thin metal plate, b) an SAE 12 as a parasitic antenna element formed in a nearly semicircular tubular form by punching and pressing a thin metal plate, c) a mounting bracket 13 for connecting and fixing one terminal end 11A of the FAE 11 (see FIGS. 2A or 2B), d) a core 14 made of an insulating material coupled with the mounting bracket 13, for fixing the FAE 11 and SAE 12 in a mutually insulating state at nearly concentrical positions, and e) a cover 15 made of an insulating material cove ring the outer circumference of the FAE 11 and SAE 12, by exposing the vicinity of a threaded portion 13A of the mounting bracket 13.

As a thin metal plate for forming the FAE and SAE, a conductive copper plate or copper alloy plate, or a conductive aluminum plate or aluminum alloy plate is suited. But any other metal may be used as far as it is conductive.

The mounting bracket 13 has a threaded portion 13A on its outer circumference for mounting this antenna device on a wireless unit to be used.

Figure 2A:
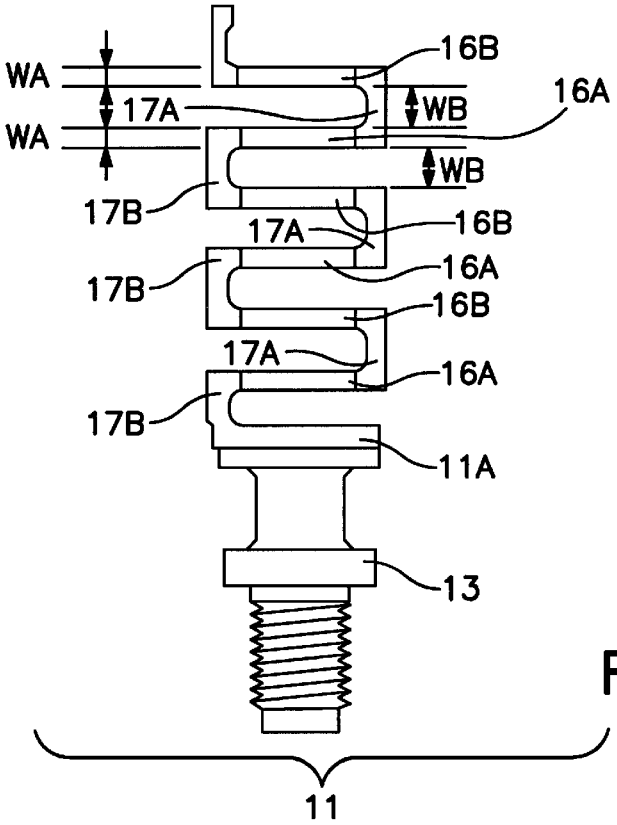
FIG. 2A is a front view of a first antenna element of he antenna device in FIG. 1.
Figure 2B:
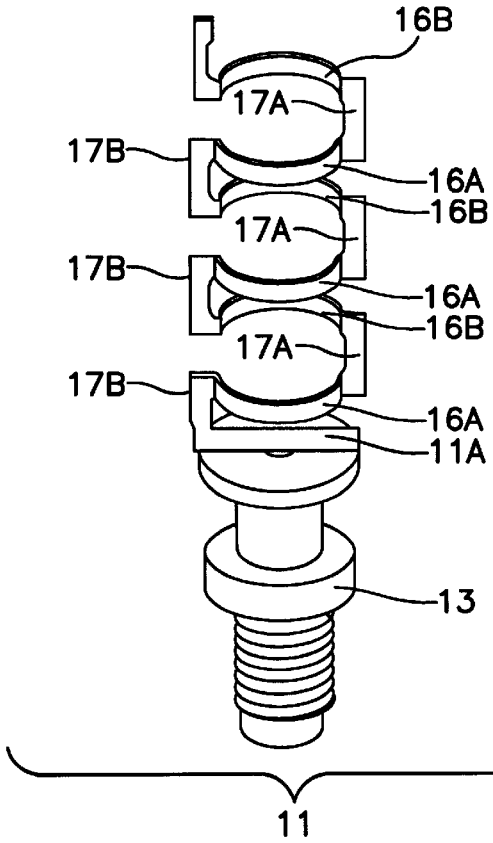
FIG. 2B is a perspective view of the first antenna element of the antenna device in FIG. 1.

The detailed shape of the FAE 11 is shown in a front view in FIG. 2A and in a perspective view in FIG. 2B. The FAE 11 is formed by blanking a thin metal plate.

In the FAE 11, being made of a thin metal plate, a terminal end 11A of the FAE 11 connected to the mounting bracket 13, plural junctions 17B, plural bands 16A projecting in a nearly semicircular form in the front direction, plural junctions 17A, and plural bands 16B projecting in a nearly semicircular form in the rear direction are formed continuously in a nearly spiral form as shown in the front view in FIG. 2A. The terminal end 11A, plural bands 16A, and plural bands 16B are formed nearly parallel to each other as seen from the front side as shown in FIG. 2A. The width WA of the bands 16A and bands 16B is nearly equal. The interval WB of the adjacent band 16A and band 16B is larger than the width WA of the band. The plural junctions 17B and plural junctions 17A are formed nearly parallel to each other as seen from the front side as shown in FIG. 2A.

Further, as shown in FIG. 2B, the plural bands 16B are processed in a nearly semicircular form to project to the inner depth, and the plural bands 16A are processed in a nearly semicircular form to project to the front side. As shown in FIG. 2B, the FAE 11 is formed, on the whole, in a nearly circular spiral form.

Figure 3A:
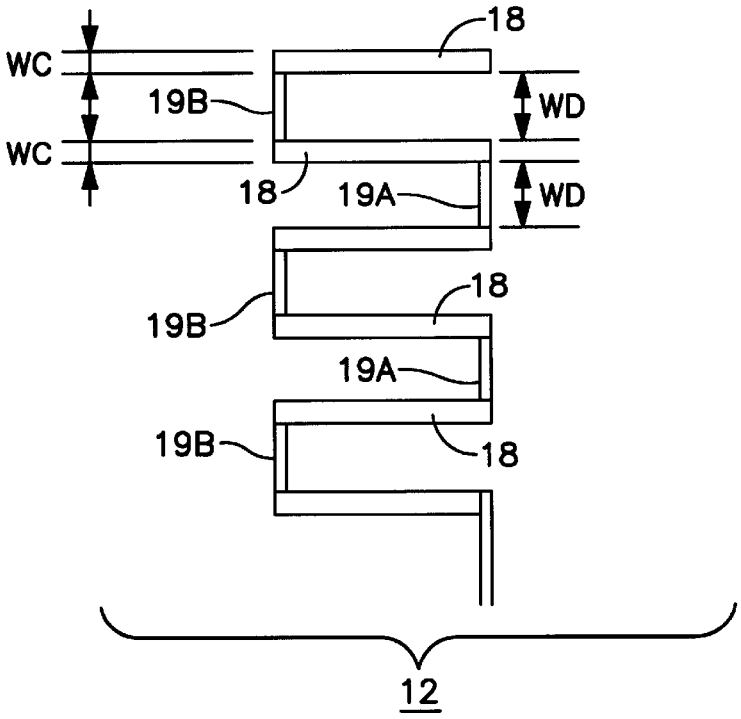
FIG. 3A is a front view of a second antenna element of the antenna device in FIG. 1.
Figure 3B:
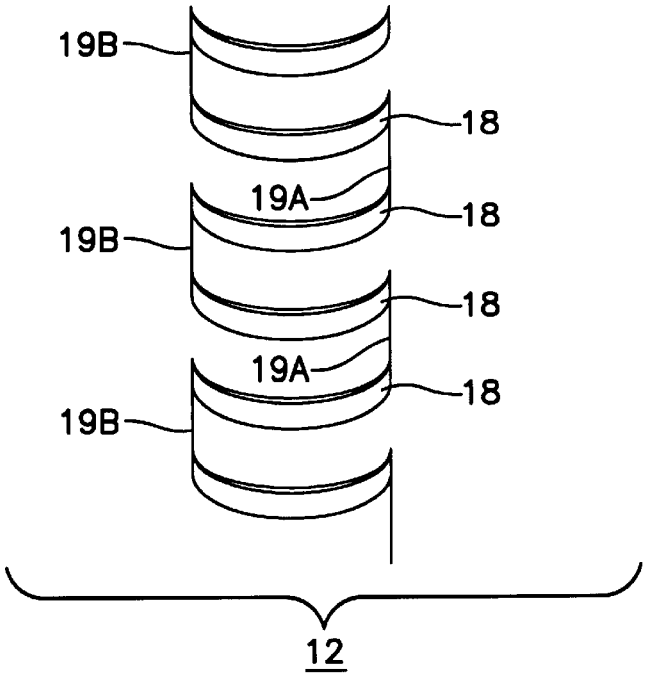
FIG. 3B is a perspective view of the second antenna element of the antenna device in FIG. 1.

The detailed shape of the SAE 12 is shown in a front view in FIG. 3A and in a perspective view in FIG. 3B. The SAE 12 is formed by blanking a thin metal plate.

In the SAE 12, being made of a thin metal plate, plural junctions 19A, plural bands 18 projecting in a nearly semicircular form, and plural junctions 19B are formed continuously in a nearly meandering form as shown in the front view in FIG. 3A. The plural bands 18 are formed nearly parallel to each other as seen from the front side as shown in FIG. 3A. The width WC of the bands 18 is nearly equal to or narrower than the width WA of the bands of the FAE 11. Supposing the interval of the mutually adjacent band 18 to be WD, the following relation is established.

$$WA+WB \approx WC+WD$$

The plural junctions 19A and plural junctions 19B are formed nearly parallel to each other as seen from the front side as shown in FIG. 3A.

Further, as shown in FIG. 3B, the plural bands 18 are processed in a nearly semicircular form to project to the front direction. The radius of the nearly semicircular form of the plural bands 18 is processed to be nearly same as the radius of the nearly circular spiral form of the FAE 11. The arc shape of the first antenna element 11 and second antenna element 12 is described later.

Figure 4A:
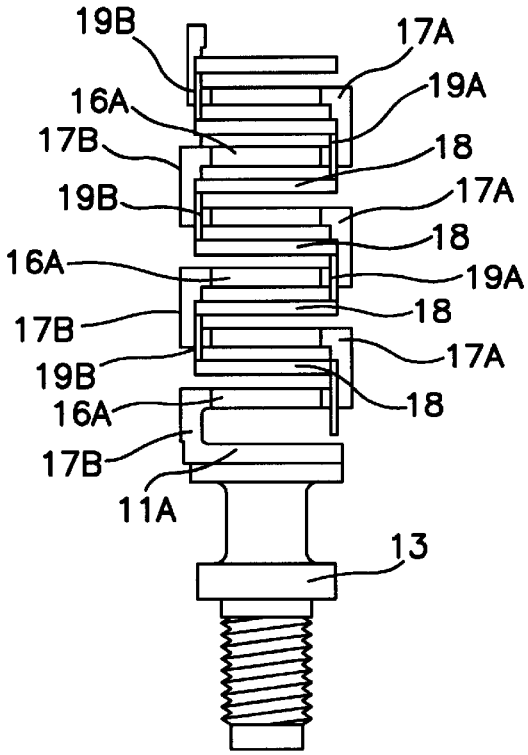
FIG. 4A is a front view of the antenna element of the antenna device in FIG. 1.
Figure 4B:
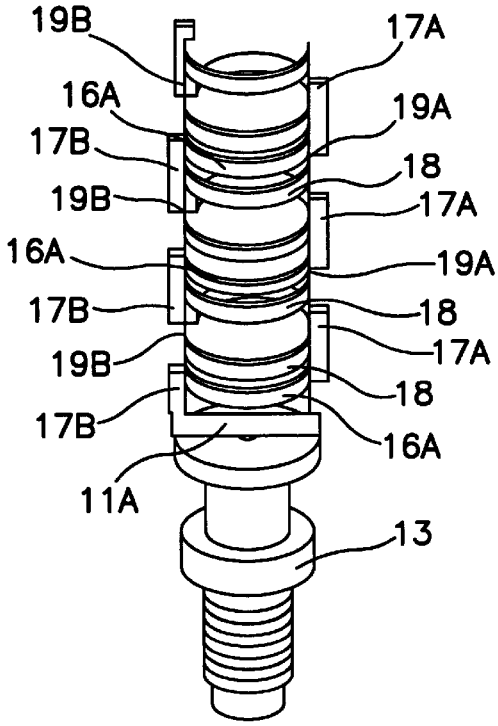
FIG. 4B is a perspective view of the antenna element of the antenna device in FIG. 1.

The configuration of the FAE 11 and SAE 12 mounted on the mounting bracket 13 is shown in a front view of the antenna element in FIG. 4A and in a perspective view in FIG. 4B. As shown in FIG. 4A and FIG. 4B, the bands 18 of the SAE 12 are combined to enter parallel while keeping an insulating state, among the plural bands 16A of the FAE 11.

The interval of a certain band 16A and its adjacent band 16A in the FAE 11 is $$WA+2WB.$$

The total dimension of a certain band 18 and its adjacent band 18 of the SAE 12 to be inserted in this interval is $$2WC+WD.$$

Hence, as mentioned above, $WA+WB \approx WC+WD$,

Further, since $WA<WB$, and $WA>WC$, it follows that $$WA+2WB>2WC+WD.$$

Therefore, the FAE 11 and SAE 12 are kept insulated from each other.

Positioning the junctions 17A, 17B, and 19A, 19B, the FAE 11 and SAE 12 are combined so as to keep an insulated state. As shown in FIG. 1, the FAE 11 and SAE 12 are supported by a core 14 made of an insulating resin. The outer circumference of the FAE 11 and SAE 12 is fixed by a cover 15 made of an insulating resin.

The core 14 and cover 15 are made of a same insulating resin. The core 14 and cover 15 are processed and formed in individual steps. Since the materials are the same, the adhesion of the core 14 and cover 15 is favorable. The level of thermal expansion of the core 14 and cover 15 is also identical. Therefore, the effect is very small due to temperature changes when using the antenna device, and the strength and other mechanical characteristics of the antenna device are stable.

A configuration of combination for maintaining the insulated state of the FAE 11 and SAE 12 is explained below.

Figure 5A:
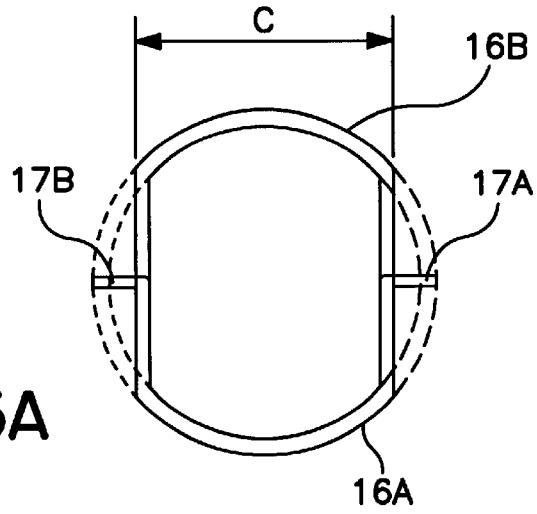
FIG. 5A is a top view of the first antenna element shown in FIGS. 2A, 2B.
Figure 5B:
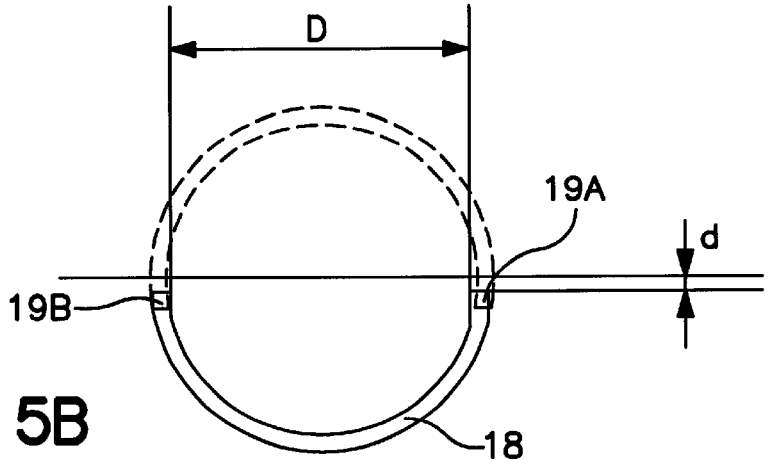
FIG. 5B is a top view of the second antenna element shown in FIGS. 3A, 3B.
Figure 5C:
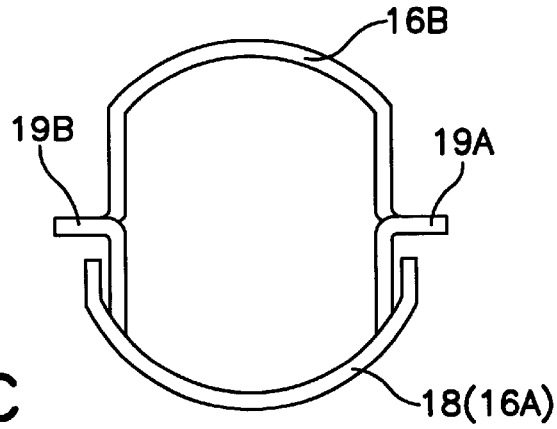
FIG. 5C is a top view showing the combined structure of the first antenna element shown in FIG. 5A and the second antenna element shown in FIG. 5B.

FIG. 5A is a top view of the FAE 11. FIG. 5B is a top view of the SAE 12. FIG. 5C is a top view showing a combined structure of FAE 11 and SAE 12.

As shown in FIG. 5A, a top view of a shape enclosed by the band 16A, junction 17A, band 17B, and junction 17B of the FAE 11 is an oval form. That is, the both sides of a circle (indicated by dotted line in FIG. 5A) formed by the arc of the band 16A and the arc of the band 16B are cut off in width C. As shown in FIG. 5B, a top view of a shape enclosed by the junction 19A, band 18, and junction 19B of the SAE 12 is nearly semicircular. It is, however, slightly smaller (dimension d in FIG. 5B) than the semicircle of the circle (indicated by dotted line in FIG. 5B) formed at the radius of the arc of the band 18. The radius of the arc of the band 16A, the arc of the band 16B, and the arc of the band 18 is nearly equal.

The relation between the width C shown in FIG. 5A and the width D shown in FIG. 5B is as follows:

$$C<D$$

FIG. 5C is a top view showing a combined structure of the FAE 11 shown in FIG. 5A and the SAE 12 shown in FIG. 5B. When composed as shown in FIG. 5C, the band 16A of the FAE 11 and the junctions 19A, 19B of the SAE 12 do not contact with each other, and an insulated state is maintained.

The antenna device of the embodiment has such structure, and the operation of this antenna device is explained below.

The antenna device shown in FIG. 1 is fixed at a specified position of a wireless unit by means of the threaded portion 13A formed on the outer circumference of the mounting bracket 13. A radio frequency signal corresponding to the radio wave sent and received by the antenna device is transmitted between the electric circuit of the wireless unit and the antenna device through the mounting bracket 13. The FAE 11 set at a specified electric length operates electrically by matching with a first frequency band. The SAE 12 set at a different electric length operates electrically by matching with a second frequency band.

The FAE 11 has an inductance L1. There is a floating capacity C1 between the mutual plural bands (16A, 16B) of the FAE 11, and between plural bands (16A, 16B) of the FAE 11 and the band 18 of the SAE 12. The electric length determined by the inductance L1 and floating capacity C1 matches with the radio frequency signal of the first frequency band. By this matching, the FAE 11 is set so as to have an impedance characteristic capable of sending and receiving radio wave of the first frequency band most efficiently.

The SAE 12 has an inductance L2. There is a floating capacity C2 between the mutual plural bands 18 of the SAE 12, and between plural bands 18 of the SAE 12 and the bands (16A, 16B) of the FAE 11. The electric length determined by the inductance L2 and floating capacity C2 matches with the radio frequency signal of the second frequency band. By this matching, the SAE 12 is set so as to have an impedance characteristic capable of sending and receiving radio wave of the second frequency band most efficiently.

The radio frequency signal of the first frequency band is directly transmitted to the electric circuit of the wireless unit from the FAE 11 through the mounting bracket 13 connected to the FAE 11. The radio frequency signal of the second frequency band is transmitted to the electric circuit of the wireless unit from the SAE 12, by making use of the capacitive coupling and electromagnetic induction coupling between the FAE 11 and SAE 12.

Thus, according to the embodiment, the antenna elements are formed by blanking and pressing a thin metal plate. Therefore, the antenna device of the embodiment is mostly free from uneven pitch or deformation of antenna elements, and is easy in assembly and inexpensive.

The electric length of the antenna element is a function of the product of the inductance of the antenna element, and the floating capacity of the antenna element itself and its peripheral parts. Generally, the inductance of the antenna element is a function of the length of the antenna element. In the antenna elements of the embodiment, since a thin metal plate is used, the floating capacity is large. Therefore, the inductance of antenna elements of the embodiment can be set smaller. That is, in the antenna elements of the embodiment, the same electric length is realized by the antenna element of a shorter length.

Therefore, the antenna device of the invention is small in size, light in weight, and high in gain and reliability.

Methods of adjusting the electric length of the FAE 11 or SAE 12 are explained below. This adjustment is intended to obtain an impedance characteristic corresponding to the frequency band.

In a first adjusting method, a part of the bands (16A, 16B) of the FAE 11 or the band 18 of the SAE 12, or an extension for adjustment provided preliminarily is cut off. By this adjustment, an impedance characteristic corresponding to the intended frequency band is obtained.

In a second adjusting method, a second strip 18 projecting ahead of the SAE 12 is inclined by a specified angle. This specified angle is an angle corresponding to a first strip 16A projecting ahead of the FAE 11.

Further, by using a plurality of SAEs 12, the FAE 11 and SAE 12 can be set at a desired electric coupling degree. For example, the SAE 12 shown in FIG. 3B may be cut into upper and lower halves. That is, plural SAEs are provided for the FAE. In this constitution, between the plural SAEs mutually, and at plural positions between them and the FAE 11, it is possible to set and adjust to a desired electric coupling degree. Accordingly, the impedance characteristic of the antenna device can be controlled easily, and the antenna device is easily applicable to a wide band.

The shape of first antenna element and second antenna element in other example of antenna device of the invention is described below.

The configuration of the second antenna device is shown in FIG. 6 to FIG. 9. Only characteristic parts different from the first antenna device are described below. The difference between the second antenna device and the first antenna device lies in the shape of the first antenna element. Other structure is identical except for the parts varying in relation to this difference.

Figure 6:
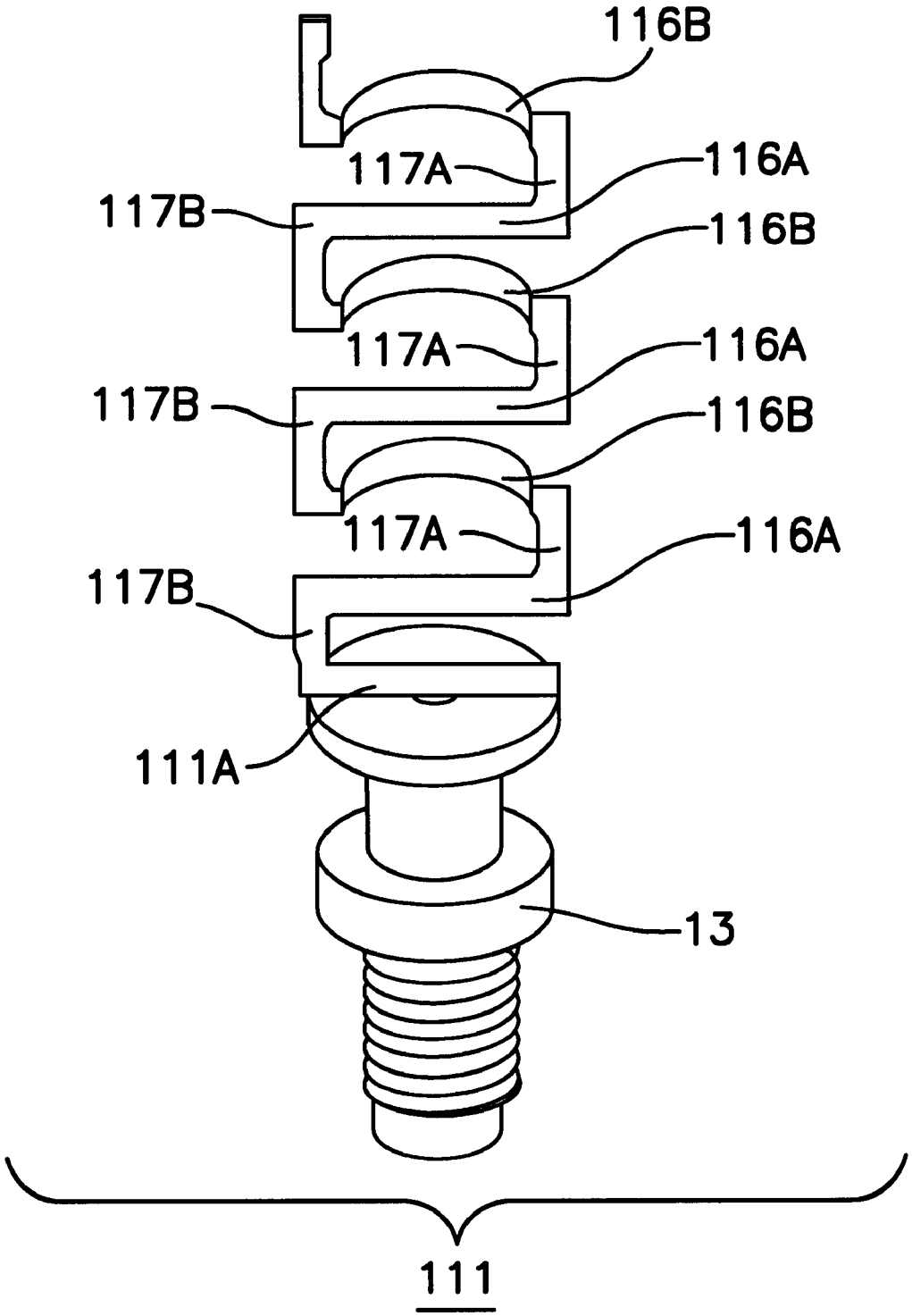
FIG. 6 is a perspective view of a first antenna element of a second antenna device.

FIG. 6 is a perspective view of a first antenna element 111 of the second antenna device. As shown in FIG. 6, a band 116B of FAE 111 is pressed in a nearly semicircular formal while a band 116A is flat. That is, the band 116A is not processed by projection. Shaping as shown in FIG. 6, the thickness of the band 116B is less than the initial thickness owing to the projection process of the band 116B.

Figure 7:
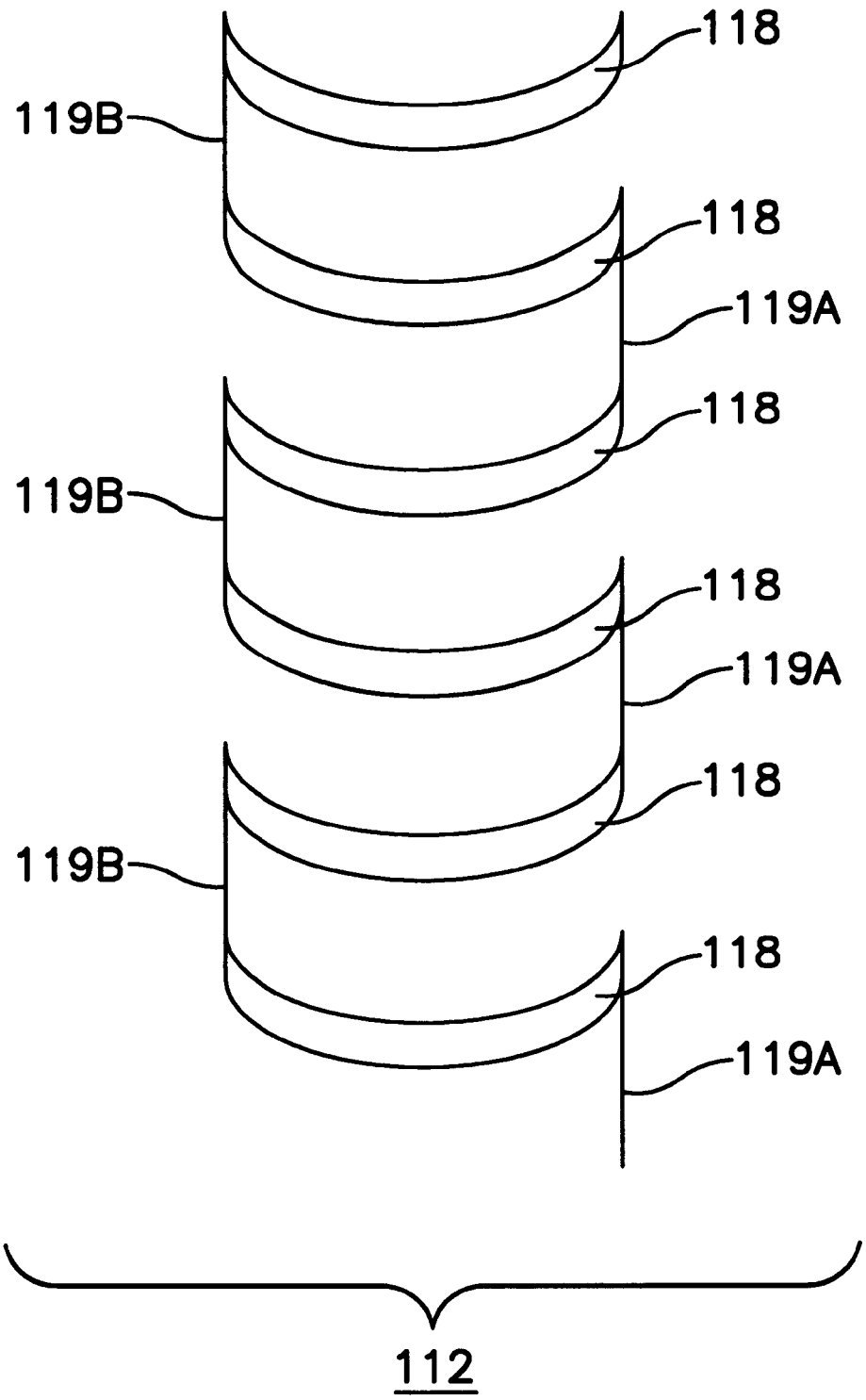
FIG. 7 is a perspective view of a second antenna element of the second antenna device.
Figure 8:
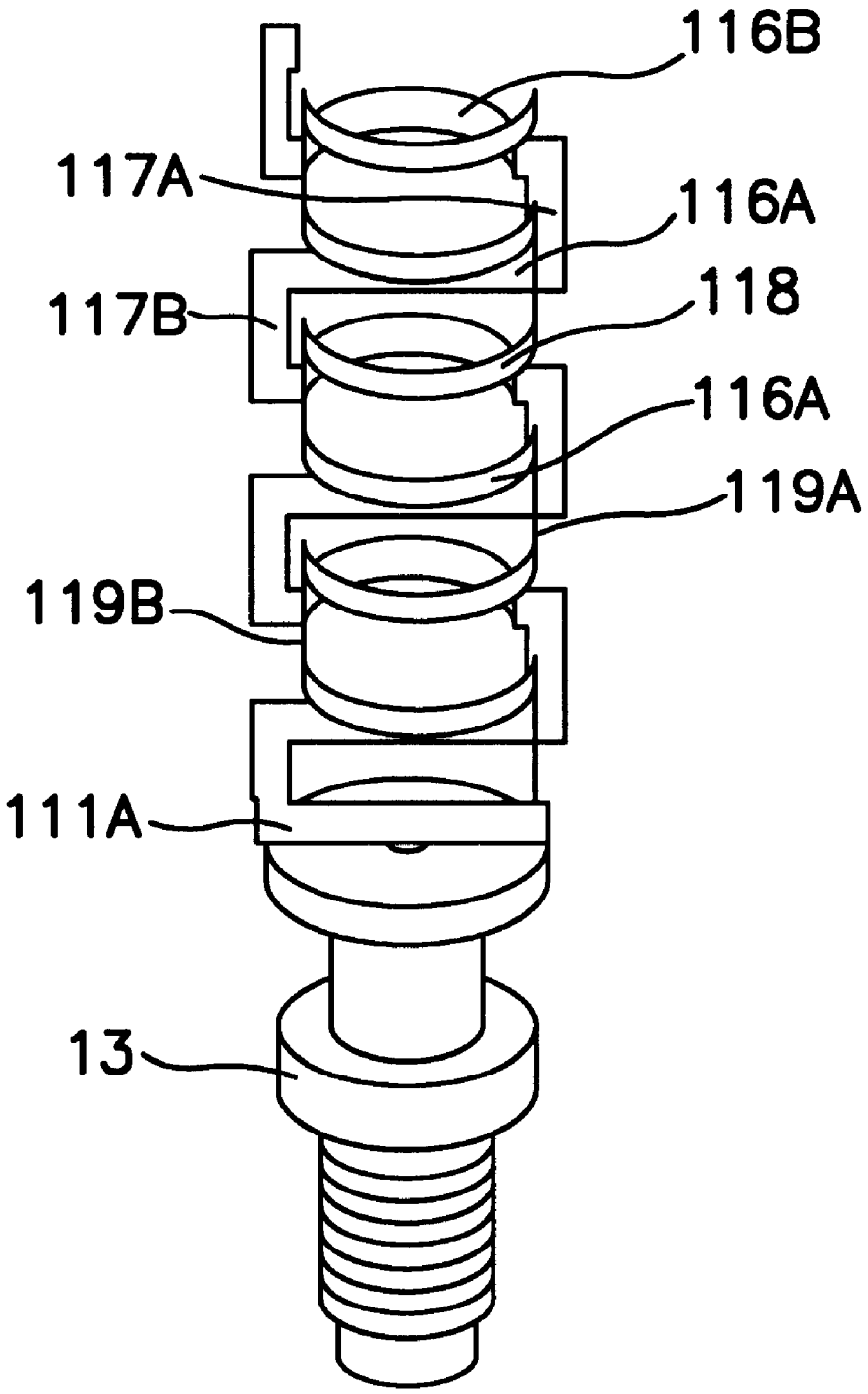
FIG. 8 is a perspective view of an antenna element combining the first antenna element and second antenna element of the second antenna device.
Figure 9A:
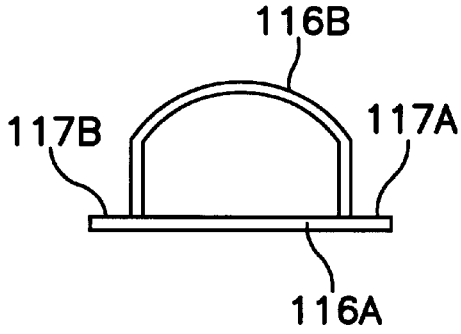
FIG. 9A is a top view of the first antenna element of the second antenna device.
Figure 9B:
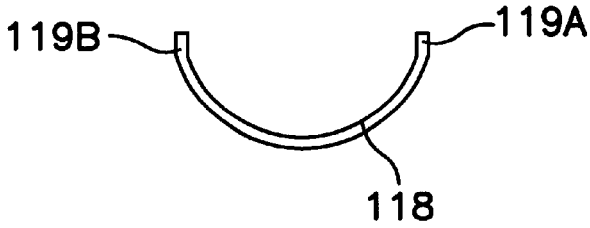
FIG. 9B is a top view of the second antenna element of the second antenna device.
Figure 9C:
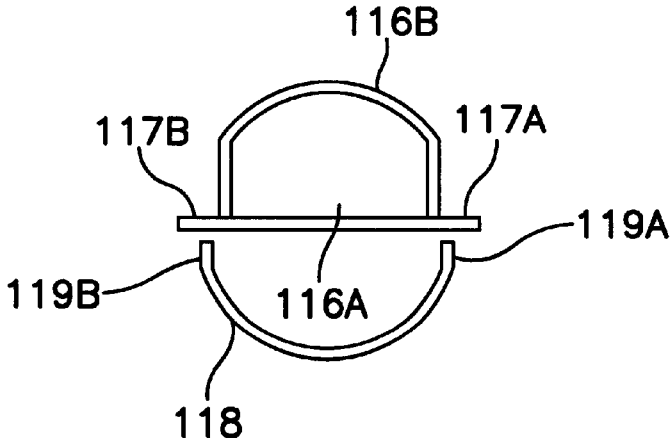
FIG. 9C is a top view of the antenna element of the second antenna device.

As shown in FIG. 7, the shape of a second antenna element 112 of the second antenna device is same as that of the second antenna element 12 of the first antenna device. FIG. 8 is a perspective view of the antenna element combining the first antenna element 111 and second antenna element 112 of the second antenna device. FIG. 9A is a top view of the first antenna element 111 of the second antenna device. FIG. 9B is a top view of the second antenna element 112 of the second antenna device. FIG. 9C is a top view of the antenna element of the second antenna device.

In the second antenna device, too, the relation of the width WA, interval WB, width WC, and interval WD is same as defined in the first antenna device.

In the second antenna device, nearly same effects as in the first antenna device are obtained.

The configuration of a third antenna device is shown in FIG. 10 to FIG. 13. Only characteristic parts different from the first antenna device are described below. The difference between the third antenna device and the first antenna device lies in the shape of the first antenna element. Other structure is identical except for the parts varying in relation to this difference.

Figure 10:
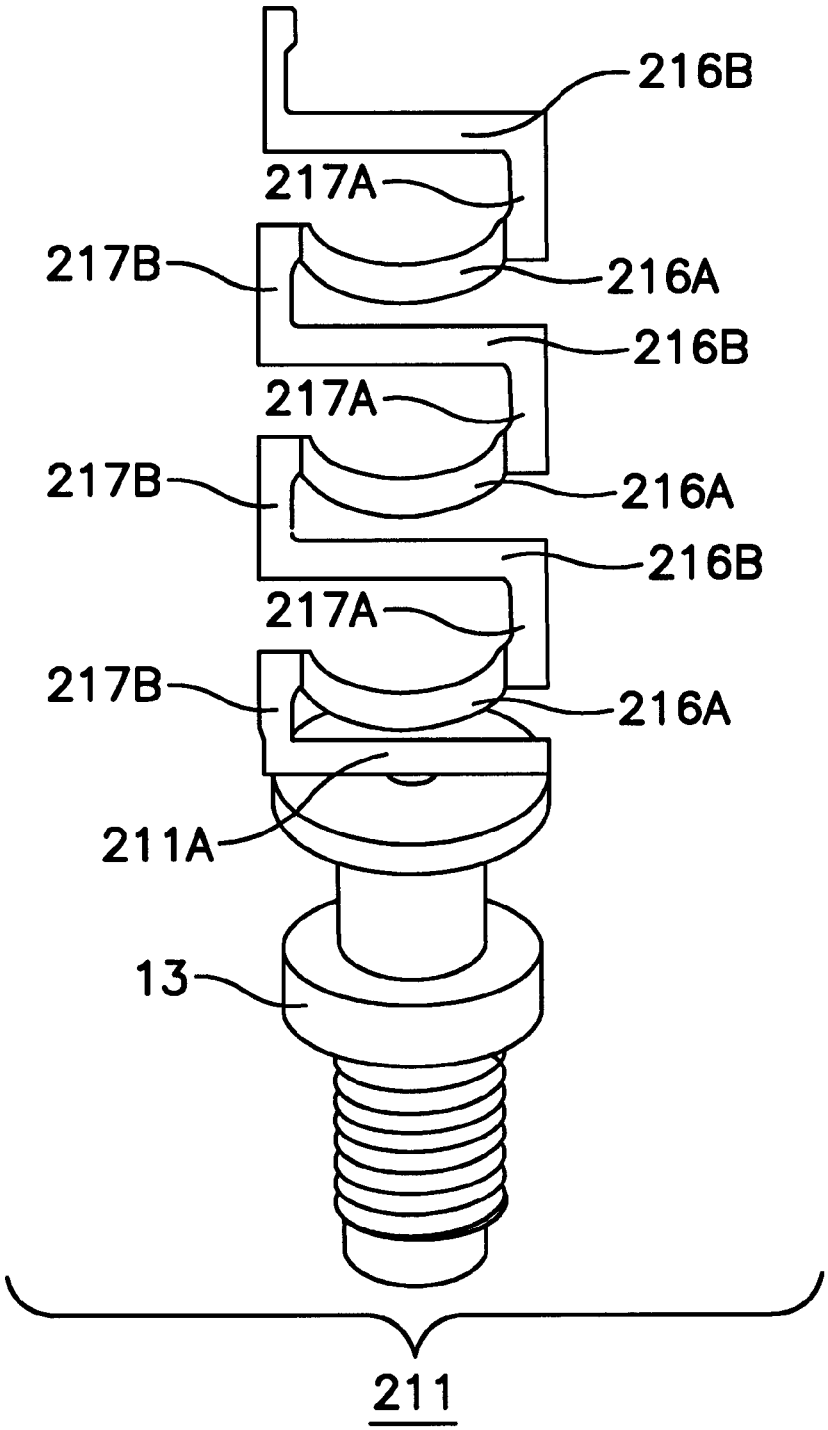
FIG. 10 is a perspective view of a first antenna element of a third antenna device.

FIG. 10 is a perspective view of a first antenna element 211 of the third antenna device. As shown in FIG. 10, a band 216A of FAE 211 is pressed in a nearly semicircular form, while a band 216B is flat. That is, the band 216B is not processed by projection. Shaping as shown in FIG. 10, the thickness of the band 216A is less than the initial thickness owing to the projection process of the band 216A.

Figure 11:
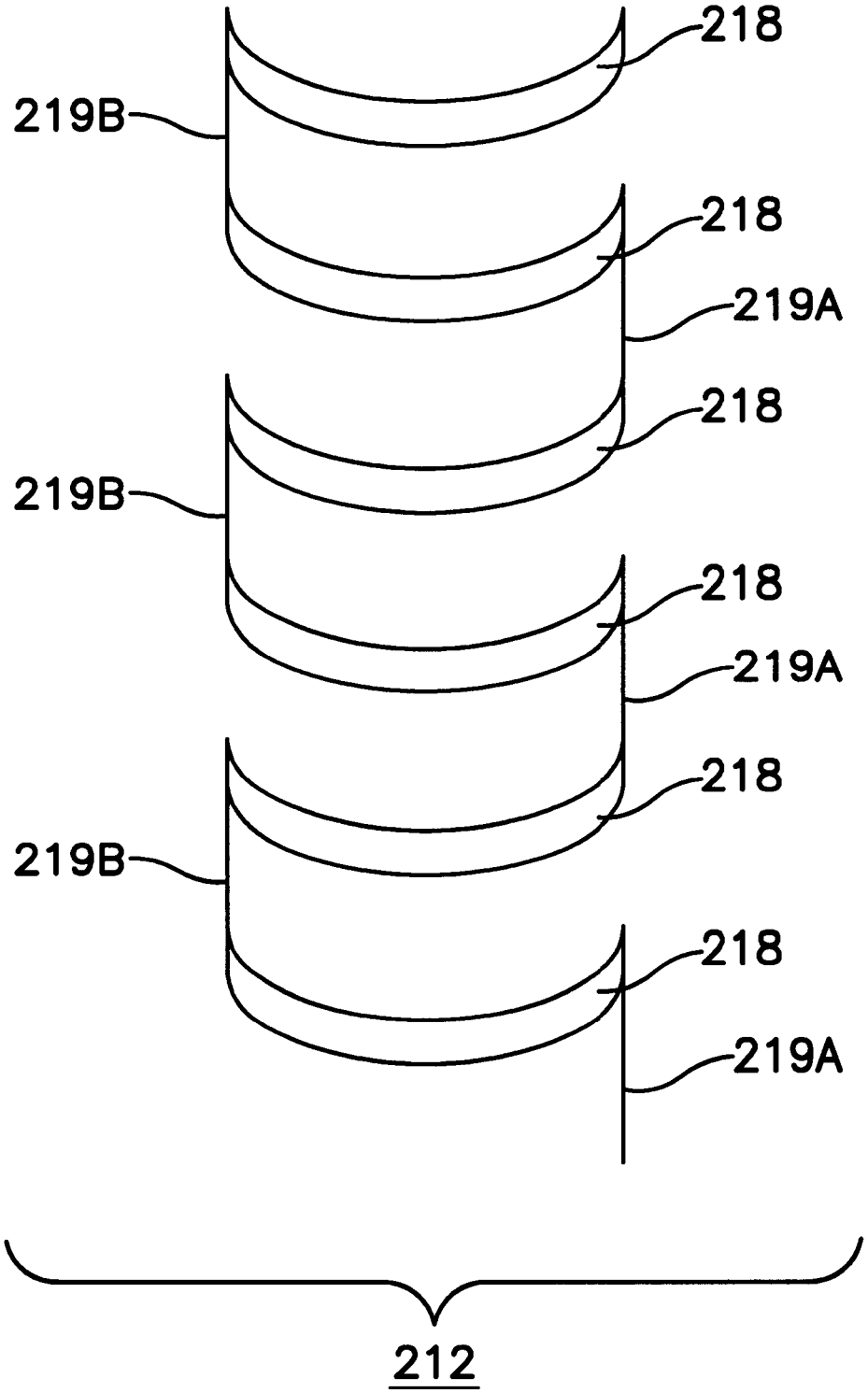
FIG. 11 is a perspective view of a second antenna element of the third antenna device.
Figure 12:
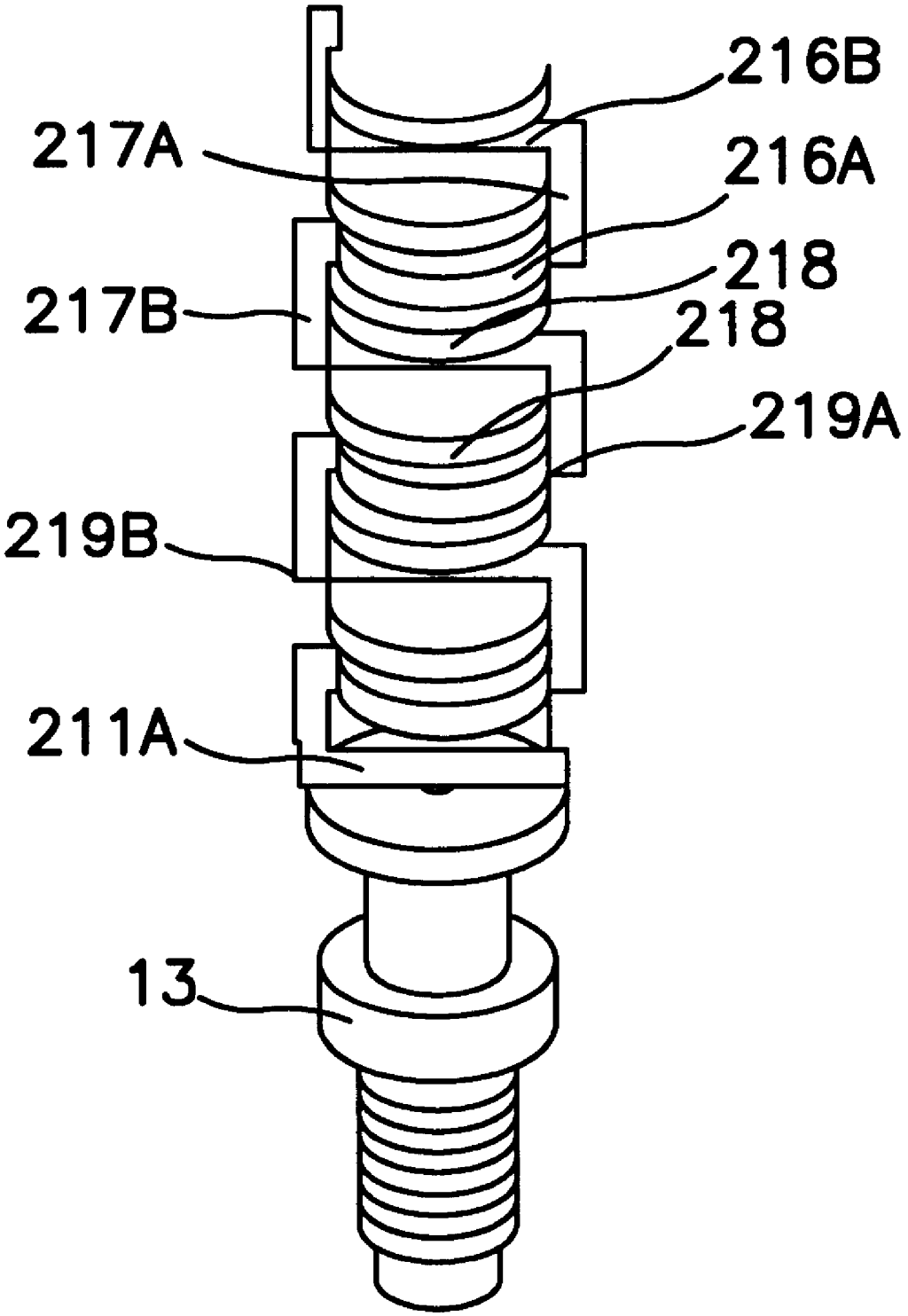
FIG. 12 is a perspective view of an antenna element combining the first antenna element and second antenna element of the third antenna device.
Figure 13A:
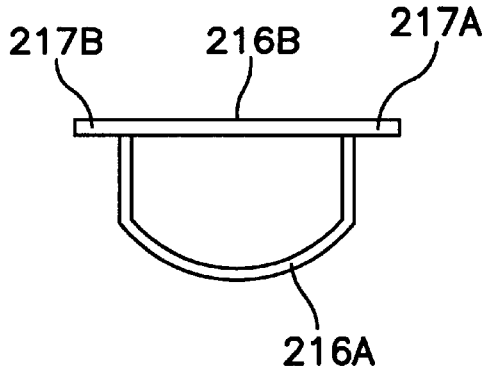
FIG. 13A is a top view of the first antenna element of the third antenna device.
Figure 13B:
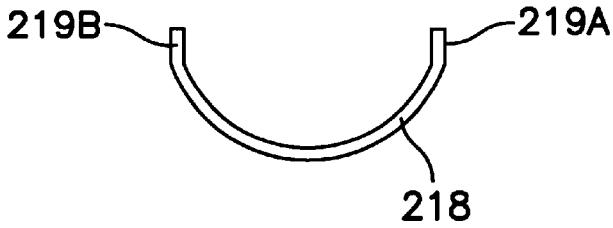
FIG. 13B is a top view of the second antenna element of the third antenna device.
Figure 13C:
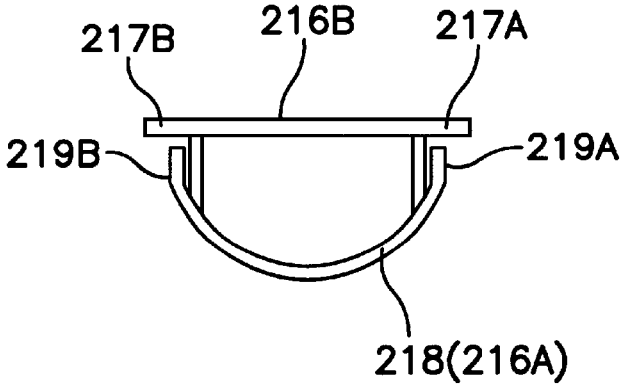
FIG. 13C is a top view of the antenna element of the third antenna device.

As shown in FIG. 11, the shape of a second antenna element 212 of the third antenna device is same as that of the second antenna element 12 of the first antenna device. FIG. 12 is a perspective view of the antenna element combining the first antenna element 211 and second antenna element 212 of the third antenna device. FIG. 13A is a top view of the first antenna element 211 of the third antenna device. FIG. 13B is a top view of the second antenna element 212 of the third antenna device. FIG. 13C is a top view of the antenna element of the third antenna device.

In the third antenna device, too, the relation of the width WA, interval WB, width WC, and interval WD is same as defined in the first antenna device.

In the third antenna device, nearly same effects as in the first antenna device are obtained.

The configuration of a fourth antenna device is shown in FIG. 14 to FIG. 17. Only characteristic parts different from the first antenna device are described below. The difference between the fourth antenna device and the first antenna device lies in the shape of the first antenna element and second antenna element. Other structure is identical except for the parts varying in relation to this difference.

Figure 14:
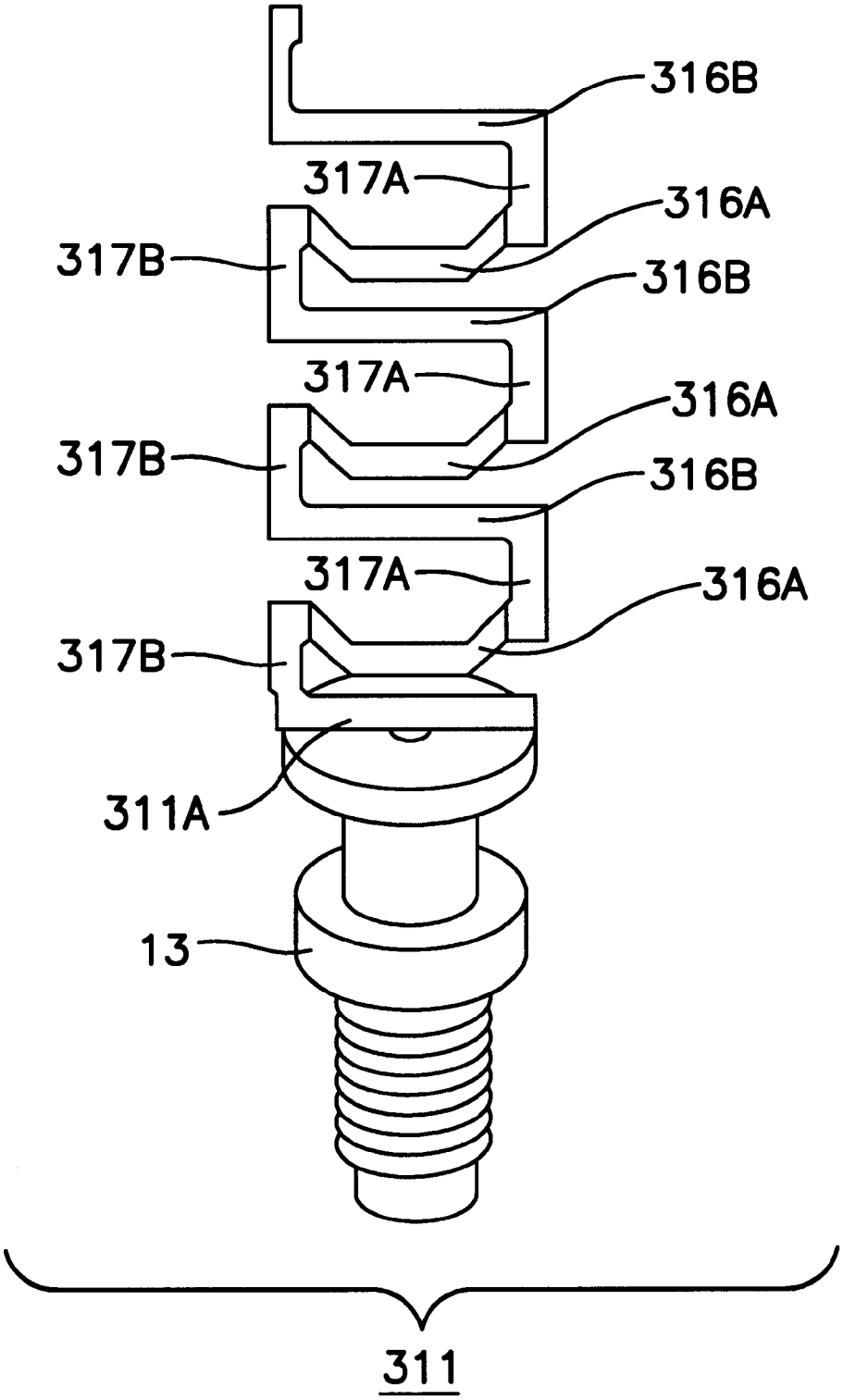
FIG. 14 is a perspective view of a first antenna element of a fourth antenna device.

FIG. 14 is a perspective view of a first antenna element 311 of the fourth antenna device. As shown in FIG. 14, a band 316A of FAE 311 is pressed in a nearly trapezoidal form, while a band 316B is flat. That is, the band 316B is not processed by projection. Shaping as shown in FIG. 14, the thickness of the band 316A is less than the initial thickness owing to the projection process of the band 316A.

Figure 15:
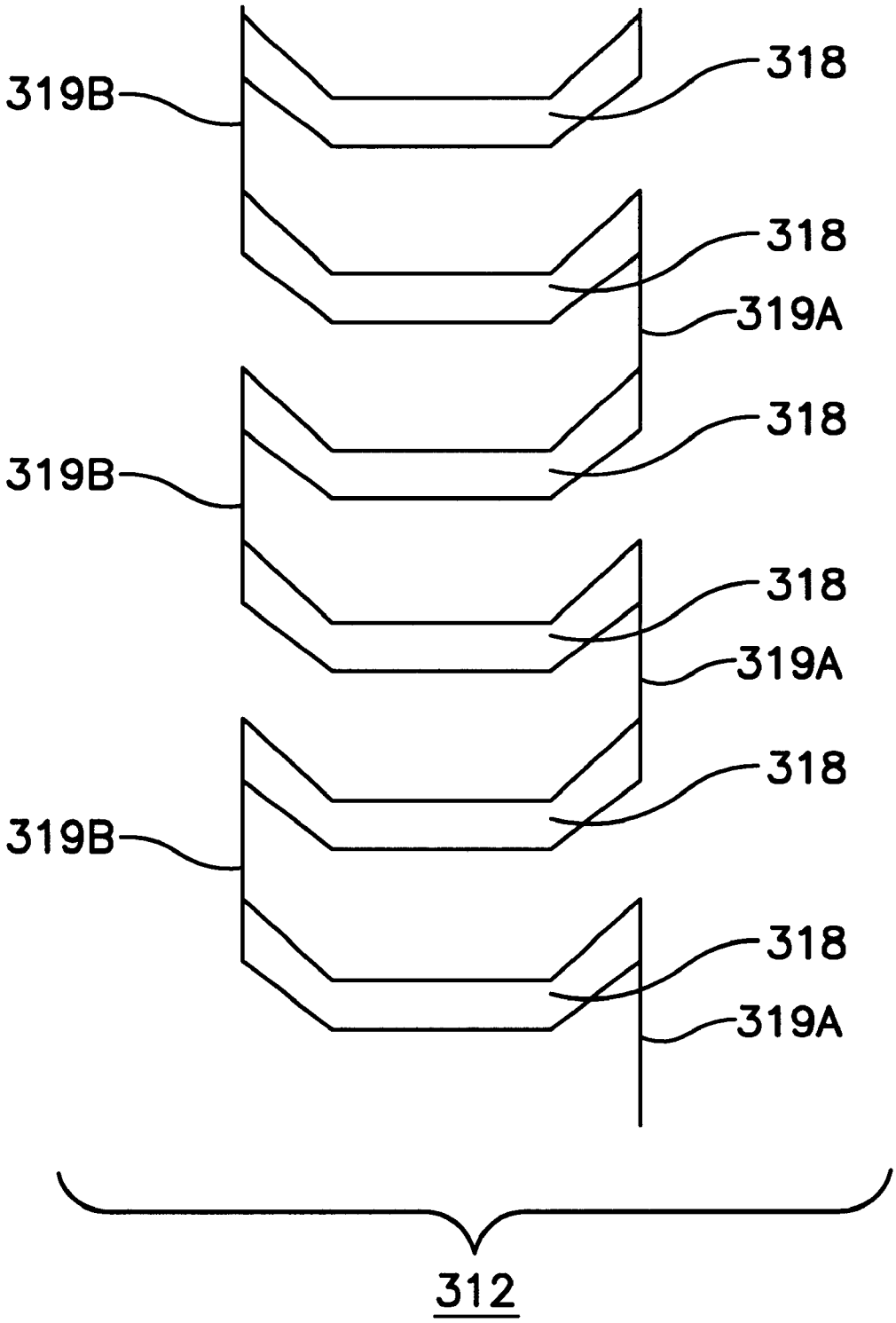
FIG. 15 is a perspective view of a second antenna element of the fourth antenna device.
Figure 16:
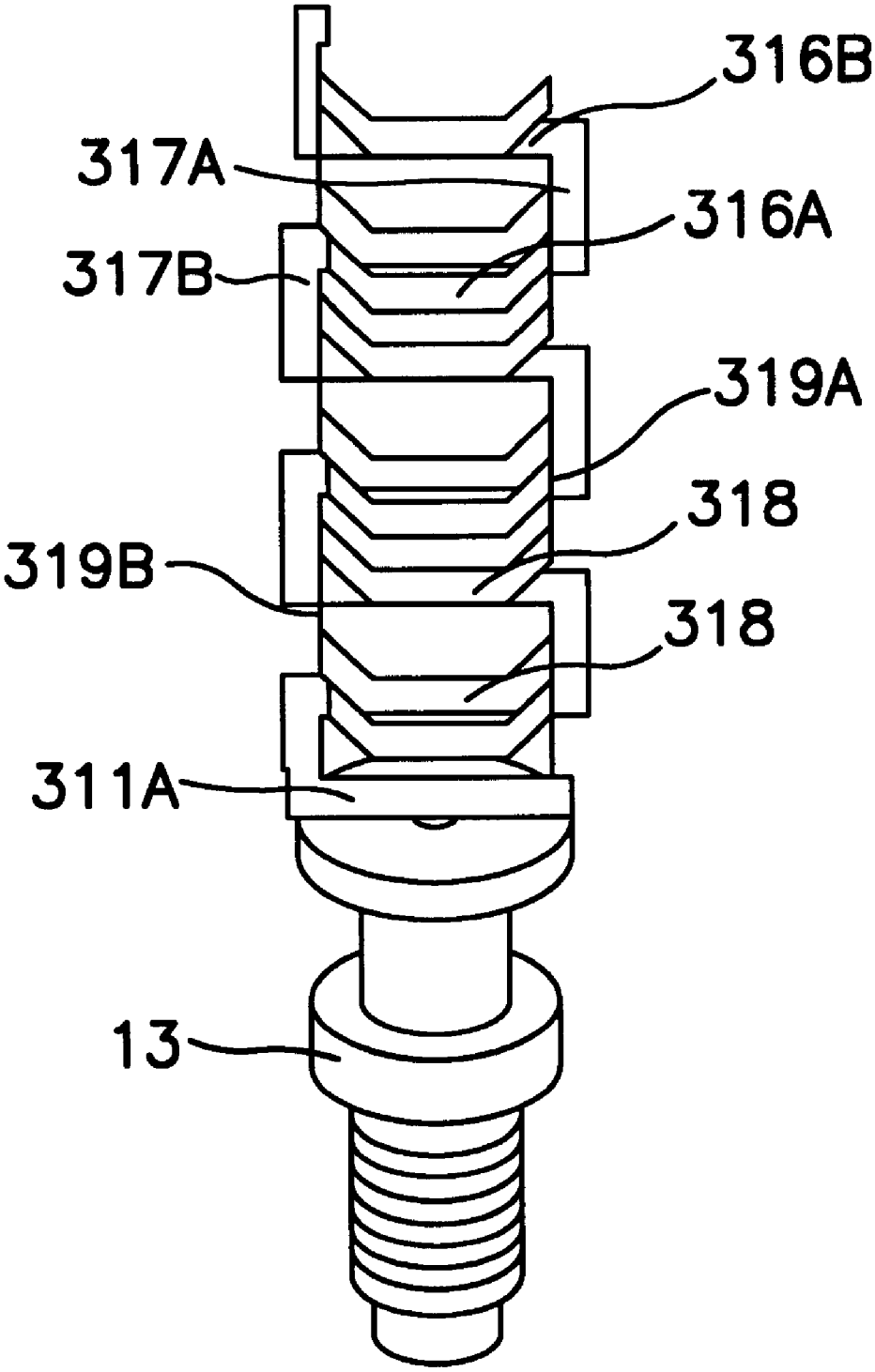
FIG. 16 is a perspective view of an antenna element combining the first antenna element and second antenna element of the fourth antenna device.
Figure 17A:
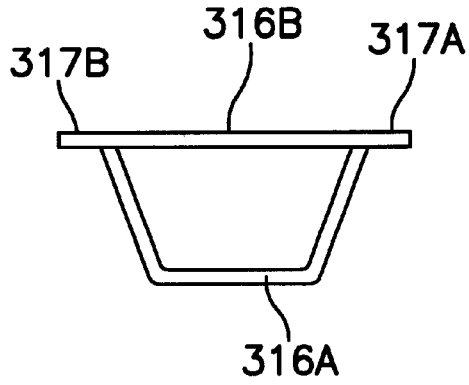
FIG. 17A is a top view of the first antenna element of the fourth antenna device.
Figure 17B:
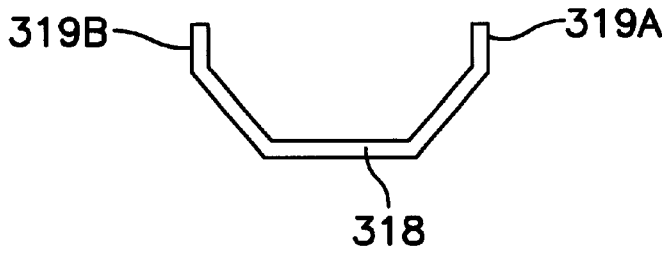
FIG. 17B is a top view of the second antenna element of the fourth antenna device.
Figure 17C:
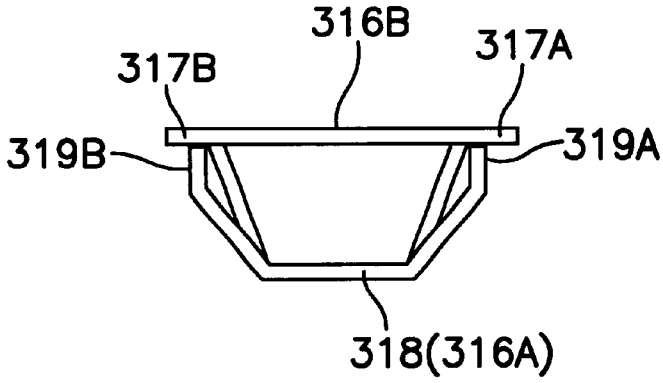
FIG. 17C is a top view of the antenna element of the fourth antenna device.

FIG. 15 is a perspective view of a second antenna element 312 of the fourth antenna device. As shown in FIG. 15, a band 318 of the SAE 312 is pressed in a nearly trapezoidal form. FIG. 16 is a perspective view of the antenna element combining the first antenna element and second antenna element of the fourth antenna device. FIG. 17A is a top view of the first antenna element 311 of the fourth antenna device. FIG. 17B is a top view of the second antenna element 312 of the fourth antenna device. FIG. 17C is a top view of the antenna element of the fourth antenna device.

In the fourth antenna device, too, the relation of the width WA, interval WB, width WC, and interval WD is same as defined in the first antenna device.

In the fourth antenna device, nearly same effects as in the first antenna device are obtained.

The configuration of a fifth antenna device is shown in FIG. 18 to FIG. 21. Only characteristic parts different from the first antenna device are described below. The difference between the fifth antenna device and the first antenna device lies in the shape of the first antenna element and second antenna element. Other structure is identical except for the parts varying in relation to this difference.

Figure 18:
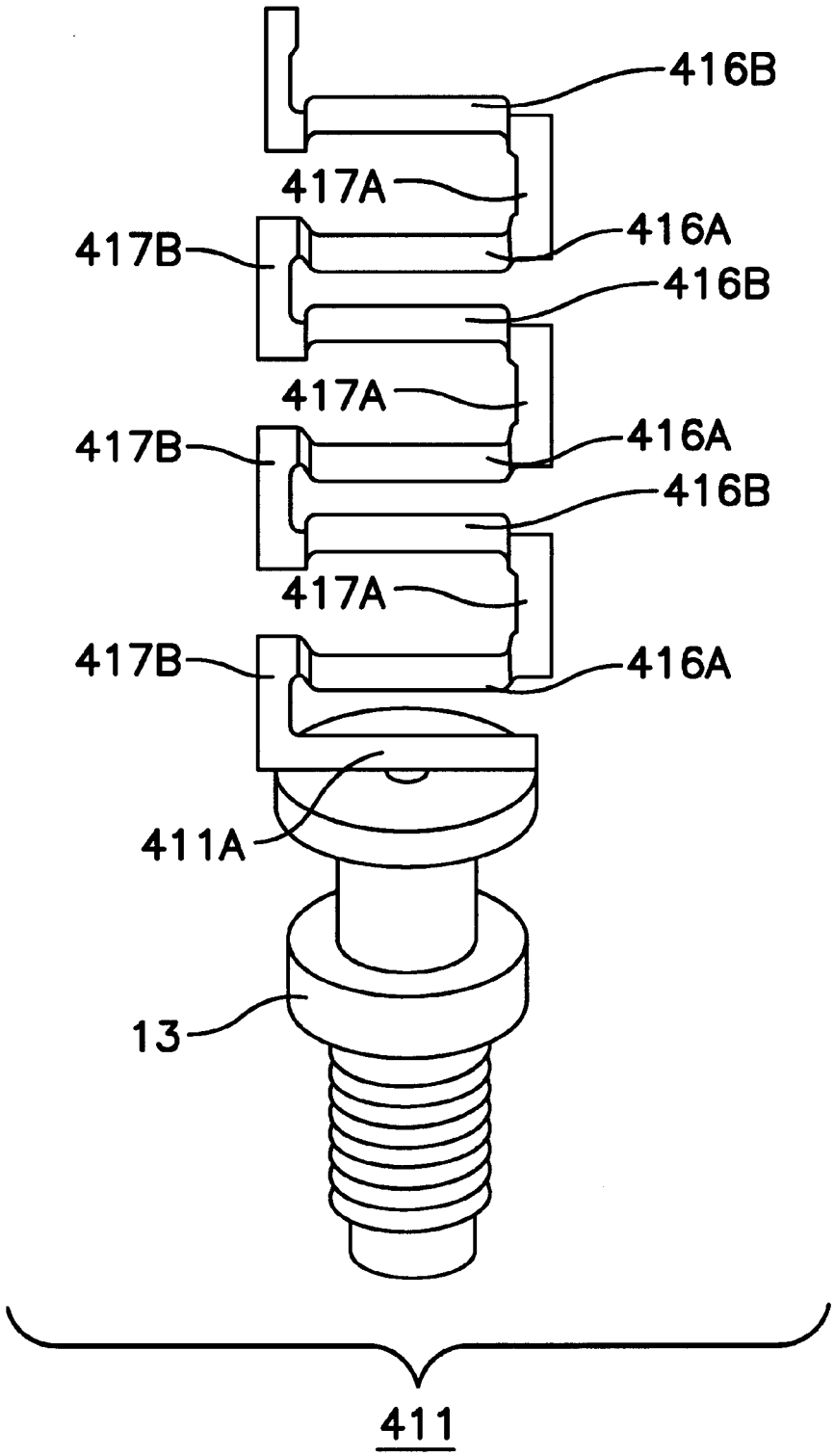
FIG. 18 is a perspective view of a first antenna element of a fifth antenna device.

FIG. 18 is a perspective view of a first antenna element of the fifth antenna device. As shown in FIG. 18, a band 416A of FAE 411 is pressed in a nearly trapezoidal form, projecting toward the front side, while a band 416B is pressed in a nearly trapezoidal form, projecting toward the rear side.

Figure 19:
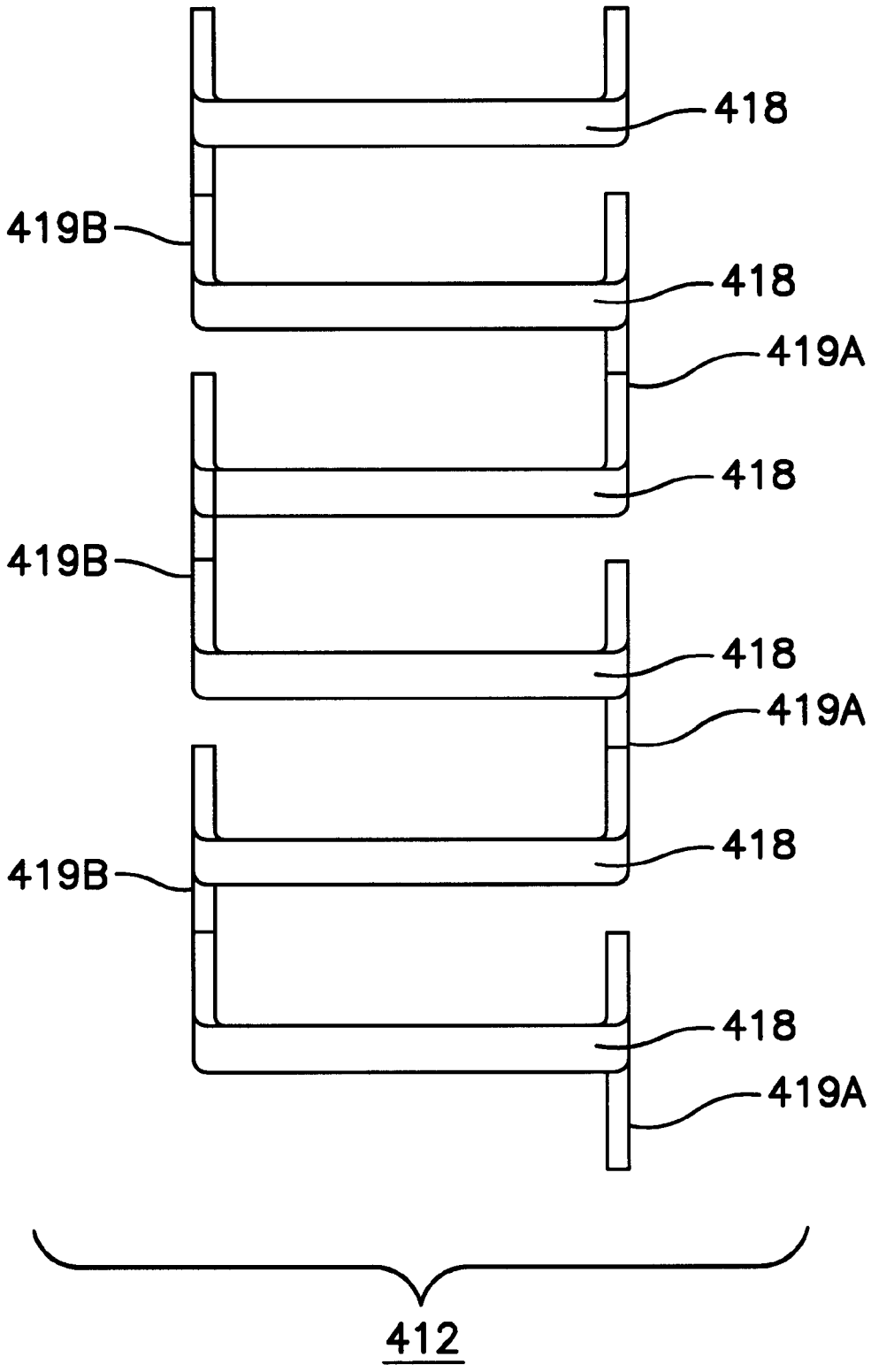
FIG. 19 is a perspective view of a second antenna element of the fifth antenna device.
Figure 20:
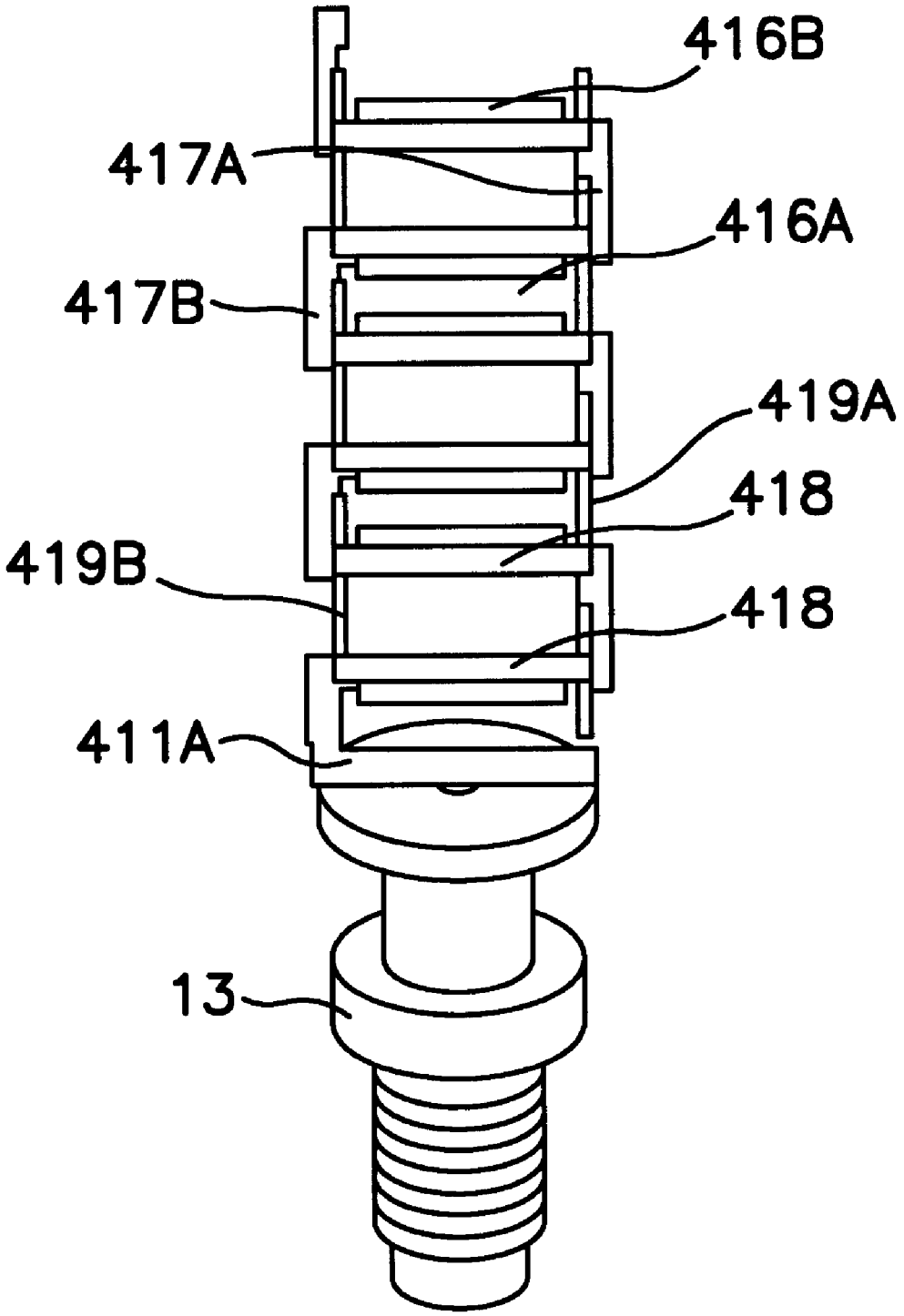
FIG. 20 is a perspective view of an antenna element combining the first antenna element and second antenna element of the fifth antenna device.
Figure 21A:
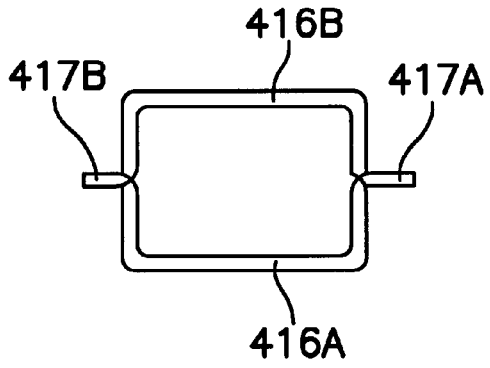
FIG. 21A is a top view of the first antenna element of the fifth antenna device.
Figure 21B:
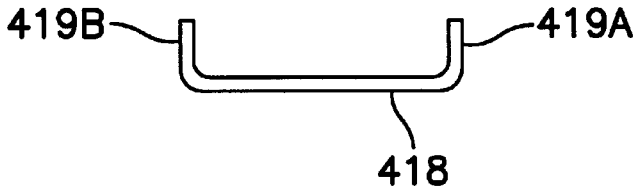
FIG. 21B is a top view of the second antenna element of the fifth antenna device.
Figure 21C:
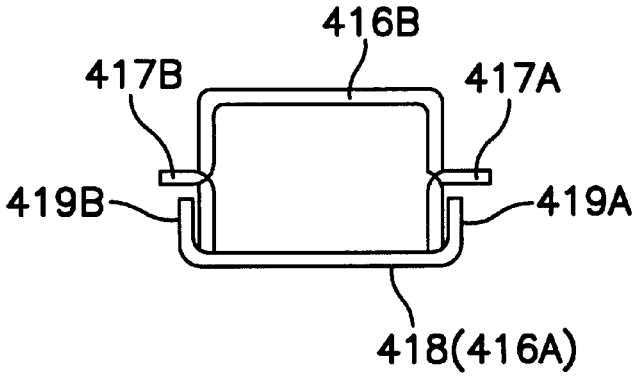
FIG. 21C is a top view of the antenna element of the fifth antenna device.

FIG. 19 is a perspective view of a second antenna element 412 of the fifth antenna device. As shown in FIG. 19, a band 418 of the SAE 412 is pressed in a nearly rectangular form. FIG. 20 is a perspective view of the antenna element combining the first antenna element 411 and second antenna element 412 of the fifth antenna device. FIG. 21A is a top view of the first antenna element 411 of the fifth antenna device. FIG. 21B is a top view of the second antenna element 412 of the fifth antenna device. FIG. 21C is a top view of the antenna element of the fifth antenna device.

In the fifth antenna device, too, the relation of t he width WA, interval WB, width WC, and interval WD is same as defined in the first antenna device.

In the fifth antenna device, nearly same effects as in the first antenna device are obtained.

Meanwhile, the first antenna element and second antenna element used in the antenna device are not limited to those shown in the first to fifth antenna devices alone. For example, the first antenna elements and second antenna elements of the first to fifth antenna devices may be used in combination. Further, other first antenna element and second antenna element conforming to the scope of the invention may be used, for example, both may be formed in square, or triangular, pentagonal or other polygonal shapes may be combined. Alternatively, one terminal end of the FAE may be formed in a shape to be connected electrically and mechanically to a specified position of a wireless unit directly, and the mounting bracket may be formed integrally.

Embodiment 2

A manufacturing method of antenna device according to a second embodiment of the invention is described below while referring to FIG. 22 to FIG. 26.

Figure 22A:
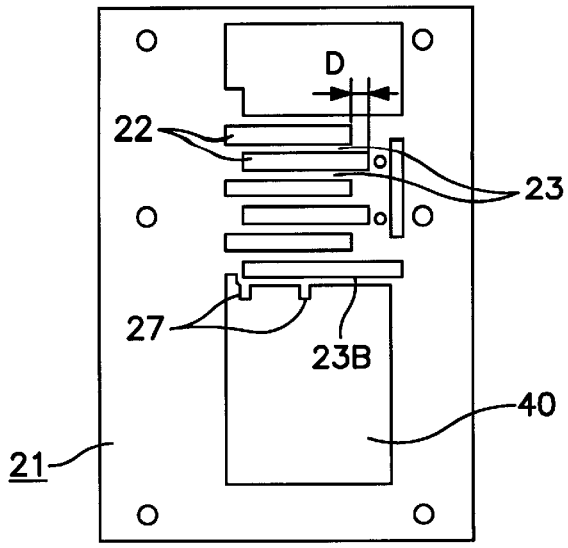
FIG. 22 is a perspective view explaining a forming method of a first element plate in a manufacturing method of antenna device according to a second embodiment of the invention.
Figure 22B:
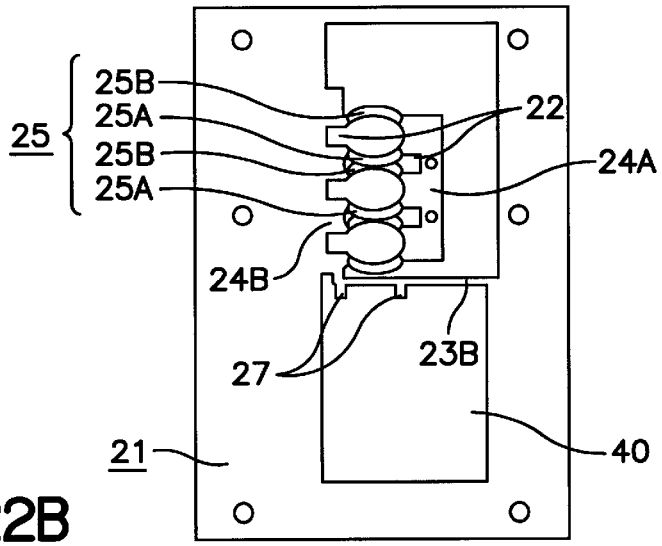
Figure 22C:
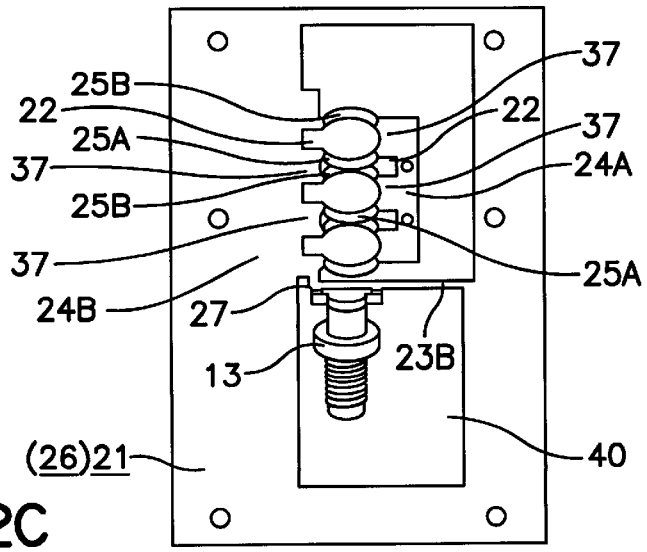

FIGS. 22A, 22B, 22C are perspective views explaining the forming method of a first antenna element plate. First, as shown in FIG. 22A, nearly parallel rectangular holes 22 of same length are punched and processed in a conductive thin metal plate 21 of a specified dimension. The plural rectangular holes 22 are formed in a convex and concave shape by shifting both ends alternately by dimension D. By this processing, plural linear portions 23 are formed between the adjacent rectangular holes 22. The linear portions 23 correspond to the bands (for example, 16A and 16B) in embodiment 1. In a later process, an opening hole 40 is formed for mounting the mounting bracket 13. Two bumps 27 for mounting the mounting bracket 13 are formed in the linear portion 23B between the rectangular hole 22 and opening hole 40 at the lowest end.

Consequently, as shown in FIG. 22B, one side 24A of the convex and concave shape of the plural rectangular holes 22 is cut off from the outer circumference in a linked state. After cutting off the side 24A, the plural linear portions 23 are processed to project in a nearly semicircular form alternately in the longitudinal direction. However, the linear portion 23B at the lowest end is not processed. Herein, as shown in FIG. 22B, the linear portion 23 projecting in the front direction on the sheet of paper is supposed to be band 25A, and the linear portion 23 projecting in the rear direction on the sheet of paper is supposed to be band 25B. In this projecting state, each end of the bands 25A, 25B remains connected to the thin metal plate 21. Other ends of the bands 25A, 25B are coupled to the outer circumference by way of the side 24A. Next, as shown in FIG. 22C, the mounting bracket 13 is connected and fixed by crimping to two bumps 27 of the linear portion 23B at the lowest end. Hereinafter, by blanking and processing the thin metal plate 21, the mounting bracket 13 is fixed, and a first antenna element plate 26 is obtained.

Figure 23A:
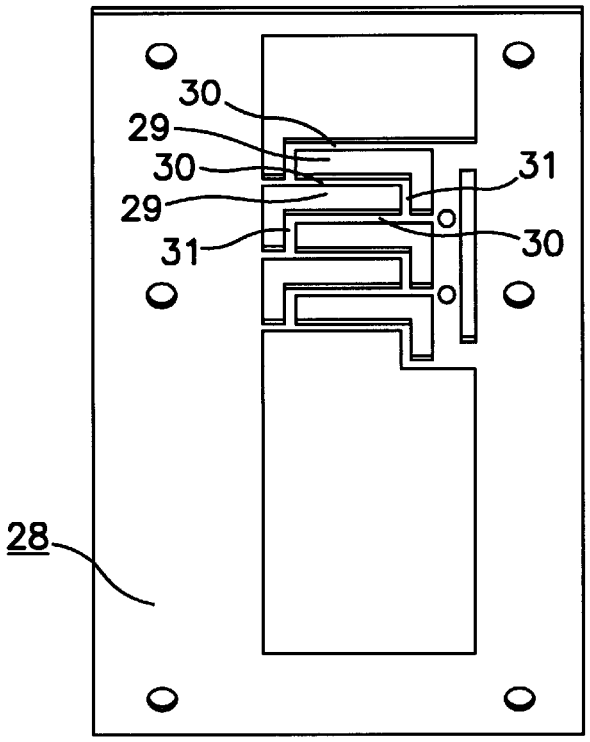
FIG. 23 is a perspective view explaining a forming method of a second element plate of the antenna device in FIG. 22.
Figure 23B:
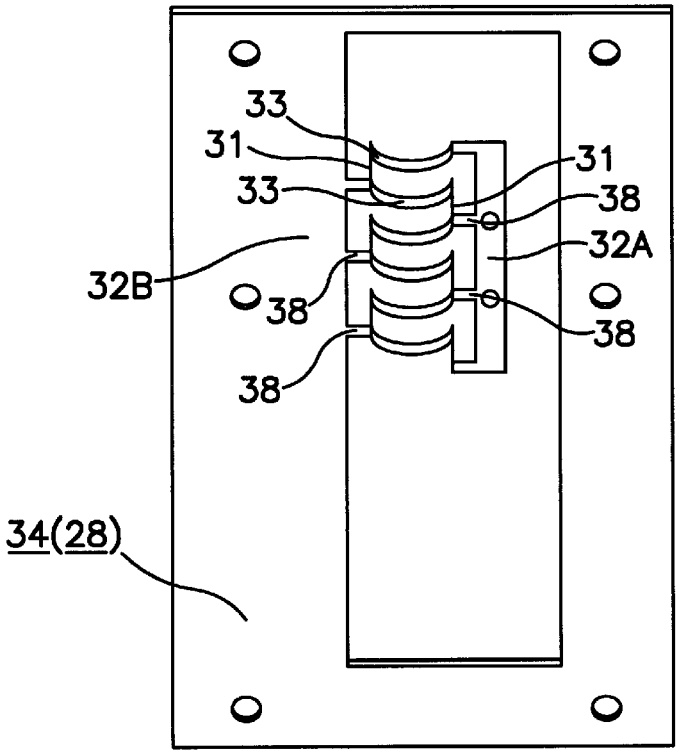

Similarly, FIGS. 23A, 23B are perspective views explaining the forming method of a second antenna element plate. First, as shown in FIG. 23A, a thin metal plate 28 of a nearly same dimension as the first antenna element plate 26 is blanked. It is blanked nearly parallel so that plural hook holes 29 of same length may be formed alternately in reverse directions. Plural linear portions 30 are formed between the adjacent hook holes 29. The plural linear portions 30 are blanked in a form linked alternately right and left by means of a linkage 31.

Consequently, as shown in FIG. 23B, one side 32A of the plural hook holes 29 is cut off from the outer circumference in a linked state. After cutting off, the plural linear portions 30 are processed to project in a nearly semicircular form in the front direction. The radius of the nearly semicircular form is nearly same as that of the bands (25A, 25B) of the first antenna element plate 26. Herein, as shown in FIG. 23B, the linear portion 30 projecting in the front direction on the sheet of paper is supposed to be band 33. The band 33 of a nearly semicircular tubular form is coupled to other side 32B through a linkage 38. Hereinafter, by blanking and processing the thin metal plate 28 as shown in FIG. 23B, a second antenna element plate 34 is obtained.

Figure 24:
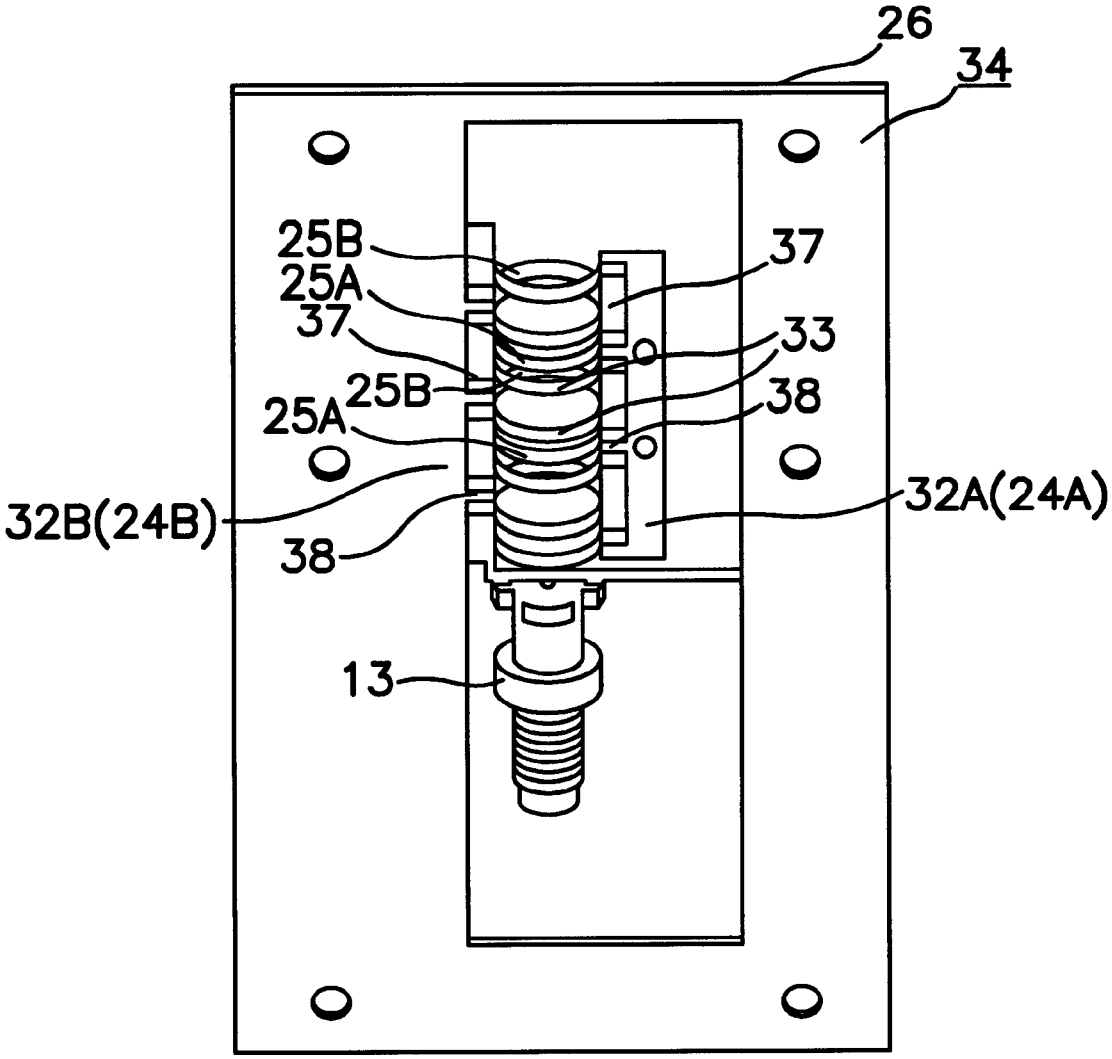
FIG. 24 is a perspective view showing a combined state of the first element plate and second element plate of the antenna device in FIG. 22.
Figure 25:
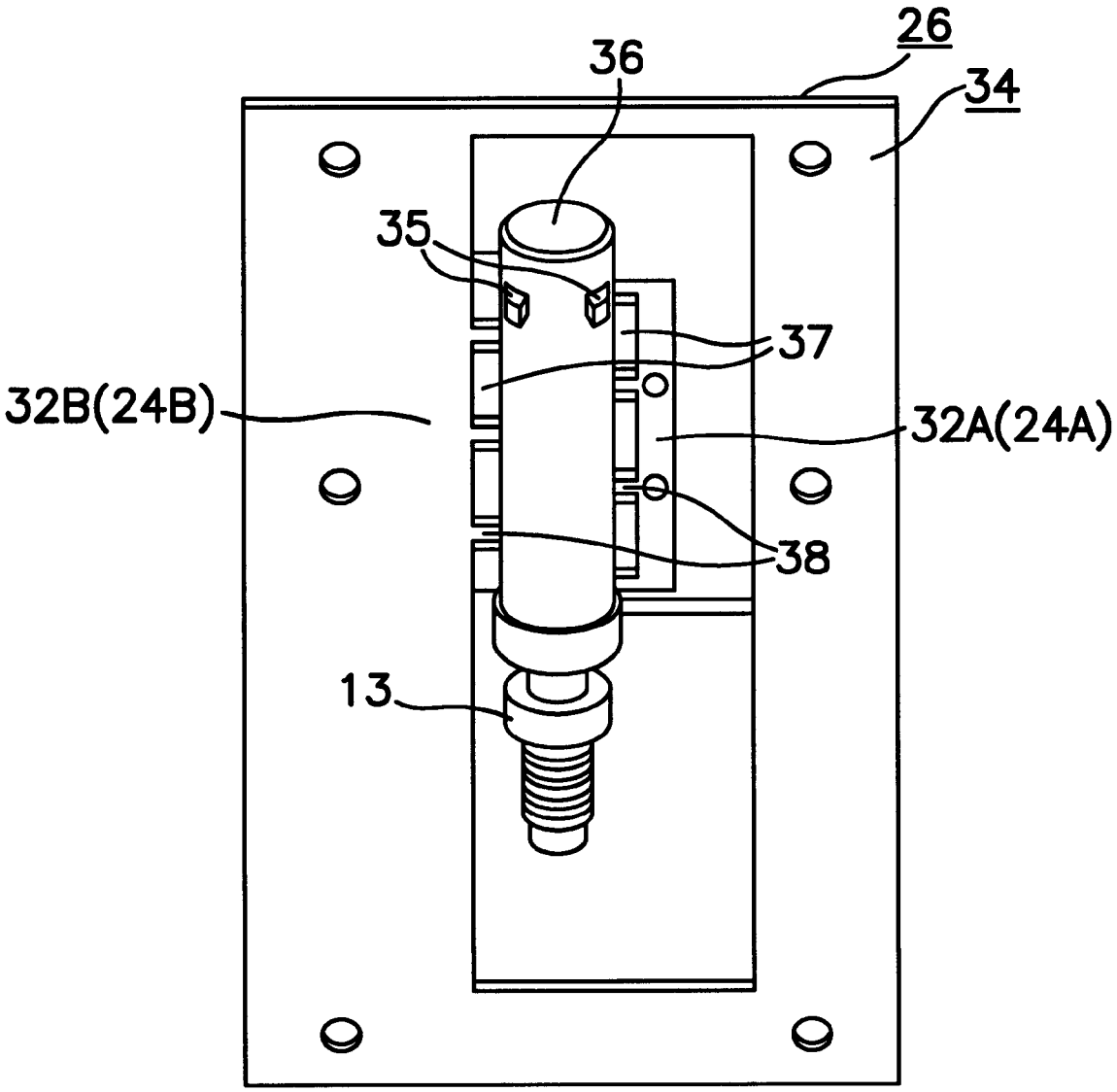
FIG. 25 is a perspective view showing a state after primary insert molding process of the antenna device in FIG. 22.

Then, as shown in a perspective view in FIG. 24, outer circumferential parts of the first antenna element plate 26 and second antenna element plate 34 are overlaid. As a result, between the upward projecting bands 25A of the first strips 25, upward projecting bands 33 are combined by entering parallel. Further, holding the outer circumference by the molding die, an insulating resin is processed by primary insert molding. Thus, as shown in a perspective view in FIG. 25, the band 25 (not shown) of the first element plate 26 and the band 33 (not shown) of the second element plate 34 are fixed from the inner side by means of the insulating resin. Still more, by this insert molding, the mounting bracket 13 is also coupled and fixed. By this insert molding, a core 36 having four resin support parts 35 projecting by a specified dimension from the outer circumference of the band 25 and band 33 is formed.

Figure 26:
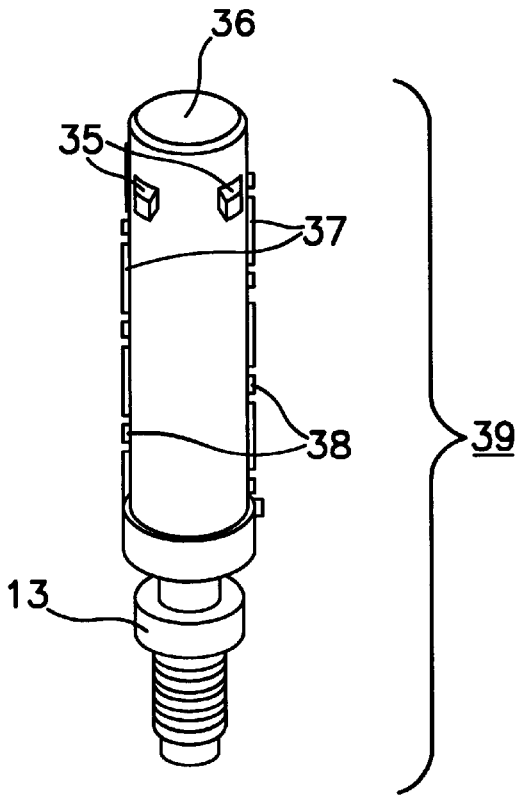
FIG. 26 is a perspective view of a core with a mounting bracket of the antenna device in FIG. 22.

As shown in a perspective view in FIG. 26, moreover, linkages 37 and 38 overlapping and projecting on the outer circumference of the core 36 are cut off near the outer circumference of the core 36. The projecting dimension of the cut-off linkages 37 and 38 from the core 36 is set so as to be smaller than the projecting dimension of the resin support parts 35. This state is shown in FIG. 26, and the core with mounting bracket 39 is obtained. By this cutting, the core with mounting bracket 39 is separated from the outer circumference of the first element plate 26 and second element plate 34.

At this time, the narrow linkage 31 of the linked portion of convex and concave ends of rectangular holes 22 of the first element plate 26, and the portion of hook holes 29 of the second element plate 34 is also cut off. As a result, the end of each band of the first element plate 26 is connected to the end of the adjacent band, and is formed in a spiral form. Therefore, a continuous FAE 11 is formed (see FIG. 2B). Also both ends of each band 33 of the second element plate 34 are connected to the ends of the bands 33 at both adjacent sides, and formed in a meandering form. Therefore, a continuous SAE 12 is formed (see FIG. 3B).

Figure 27:
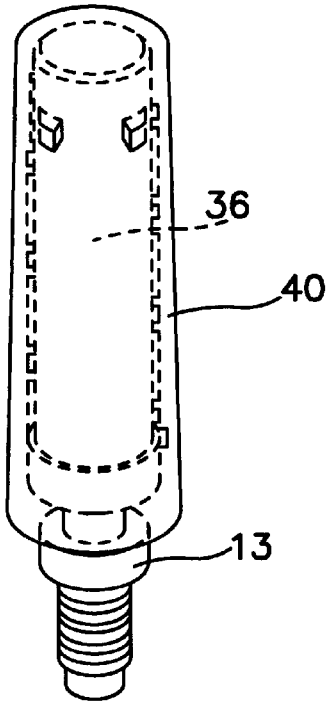
FIG. 27 is a perspective view showing a state after secondary insert molding process of the antenna device in FIG. 22.
Figure 28:
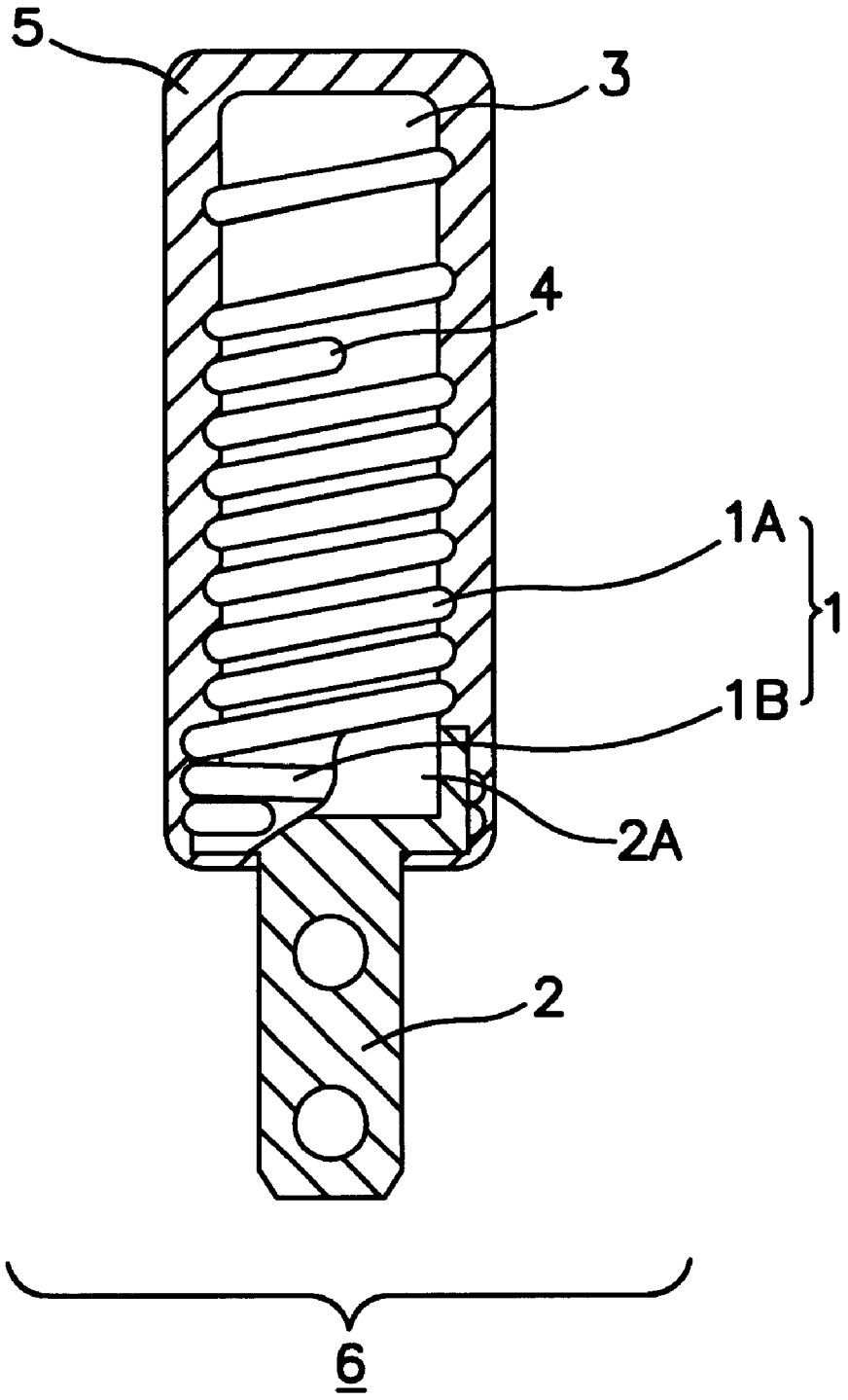
FIG. 28 PRIOR ART
FIG. 28 is a sectional view of a conventional antenna device.

The resin support parts 35 of the mounting bracket 13 of the core with mounting bracket 39 and the outer circumference of the core 36 being thus separated are held by the molding die. In this state, by the same insulating resin as in the primary insert molding process, the core with mounting bracket 39 is processed by secondary insert molding so that a threaded portion 13A of the mounting bracket 13 may be exposed. By this secondary insert molding, as shown in a perspective view in FIG. 27, the antenna device of the embodiment is completed by forming a cover 15 for covering the FAE 11 and SAE 12.

Thus, according to the embodiment, the antenna device small in fluctuation of gain and having two or more impedance characteristics can be manufactured stably by a method hardly causing deformation of antenna elements during the process.

The explanation of the manufacturing method in embodiment 2 relates to the first antenna device of embodiment 1 shown in FIG. 1 to FIG. 5. But, the manufacturing method of embodiment 2 may be similarly applied in manufacture of the second to fifth antenna devices shown in FIG. 6 to FIG. 21.

INDUSTRIAL APPLICABILITY

As described herein, according to the invention, the antenna device having two or more impedance characteristics, hardly causing uneven pitch or deformation of antenna elements, and high in gain and reliability is easily obtained. The invention also provides a manufacturing method of antenna device having two or more impedance characteristics, hardly causing uneven pitch or deformation of antenna elements, and excellent in productivity.

The antenna device of the invention can be used in wireless unit for mobile communication or the like, personal computer, transceiver, professional communication (for example, taxi, fishing boat, police), and other wireless unit for wireless communication.

What is claimed is:

1. An antenna device comprising:

a) a first antenna element of spiral form having nearly parallel plural bands formed so that both ends of the plural bands may be connected alternately and consecutively, and formed so that at least one of the plural bands may be projected, b) a second antenna element of meandering form having nearly parallel plural bands formed so that both ends of the plural bands may be connected alternately and consecutively, and formed so that at least one of the plural bands may e projected, c) a core made of an insulating resin for disposing said first antenna element and second antenna element as being insulated from each other, d) a mounting bracket connected to one end of said first antenna element, and e) a cover made of an insulating resin for covering the outer circumference of said first antenna element, second antenna element, core and mounting bracket, while exposing a part of said mounting bracket.

2. The antenna device of claim 1, wherein said plural bands of the first antenna element have a shape so that a conductive thin metal plate is punched and then projected.

3. The antenna device of claim 1, wherein at least two or more bands of said plural bands of the first antenna element are formed to project alternately.

4. The antenna device of claim 3, wherein at least two or more bands of said plural bands of the first antenna element are formed to project alternately in a nearly semicircular form in the longitudinal direction.

5. The antenna device of claim 3, wherein at least two or more bands of said plural bands of the first antenna element are formed to project by every other one in a nearly semicircular form.

6. The antenna device of claim 3, wherein at least two or more bands of said plural bands of the first antenna element are formed to project alternately in a nearly trapezoidal form in the longitudinal direction.

7. The antenna device of claim 3, wherein at least two or more bands of said plural bands of the first antenna element are formed to project by every other one in a nearly trapezoidal form.

8. The antenna device of claim 3, wherein at least two or more bands of said plural bands of the first antenna element are formed to project alternately in a nearly square form in the longitudinal direction.

9. The antenna device of claim 3, wherein at least two or more bands of said plural bands of the first antenna element are formed to project by every other one in a nearly square form.

10. The antenna device of claim 3, wherein at least two or more bands of said plural bands of the first antenna element are formed to project alternately in a nearly polygonal form in the longitudinal direction.

11. The antenna device of claim 3, wherein at least two or more bands of said plural bands of the first antenna element are formed to project by every other one in a nearly polygonal form.

12. The antenna device of claim 1, wherein said plural bands of the second antenna element are formed to project after punching a conductive thin metal plate.

13. The antenna device of claim 1, wherein at least two or more bands of said plural bands of the second antenna element are formed to project in a same direction.

14. The antenna device of claim 13, wherein at least two or more bands of said plural bands of the second antenna element are formed to project in a nearly semicircular form in a same direction.

15. The antenna device of claim 13, wherein at least two or more bands of said plural bands of the second antenna element are formed to project in a nearly trapezoidal form in a same direction.

16. The antenna device of claim 13, wherein at least two or more bands of said plural bands of the second antenna element are formed to project in a nearly square form in a same direction.

17. The antenna device of claim 13, wherein at least two or more bands of said plural bands of the second antenna element are formed to project in a nearly polygonal form in a same direction.

18. The antenna device of claim 1, further comprising an extension for adjustment preliminarily formed for cutting off part of the plural bands of the first antenna element or plural bands of the second antenna element, for adjusting the electric length of the first antenna element or second antenna element.

19. The antenna device of claim 1, wherein the width between junctions at both ends of the plural bands formed spirally in said first antenna element is set smaller than the width between junctions at both ends of the plural bands projecting in a meandering form of said second antenna element.

20. The antenna device of claim 1, wherein the plural bands disposed nearly parallel of said second antenna element are inclined by a specified angle to the plural bands disposed nearly parallel of said first antenna element.

21. The antenna device of claim 1, wherein the insulating resin for forming said core and the insulating resin for forming said cover are the same.

22. The antenna device of claim 1, wherein said mounting bracket is formed integrally with said first antenna element.

23. A manufacturing method of antenna device comprising the steps of:

a) forming a first element plate by punching a conductive thin metal plate of a specified dimension and pressing a part of said punched thin metal plate, b) forming a second element plate by a step of punching a conductive thin metal plate of a nearly same dimension as said first element plate, and a step of pressing a part of said punched thin metal plate, c) stacking up the outer circumferential parts of said first element plate and second element plate in the thickness direction, d) insert molding for forming a core having a plurality of resin support parts by fixing the pressed portion of the stacked first element plate and the pressed portion of the second element plate, e) cutting off the outer circumference of said first element plate and second element plate being stacked up, near said core, and separating said core including the pressed portion of said first element plate and the pressed portion of said second element plate from said outer circumference, and f) insert molding for forming a cover for covering the outer circumference by holding said resin support parts of said core.

24. The manufacturing method of antenna device of claim 23, wherein said step of forming said first element plate comprises the steps of:

punching a conductive thin metal plate of a specified dimension, and providing nearly parallel plural rectangular holes of same length so that both ends may be convex and concave alternately, thereby forming plural linear portions, separating one side of convex and concave portion of the plural rectangular holes from the outer circumferential part in a linked state, and projecting at least a part of the plural linear portion, in a state coupled to the outer circumference at other side.

25. The manufacturing method of antenna device of claim 23, wherein said step of forming said second element plate comprises the steps of:

punching a conductive thin metal plate in a state of plural linear portions linked alternately right and left at narrow linkage, so that nearly parallel plural hook holes of same length may be alternately reverse in direction, separating one side of said plural hook holes from the outer frame in a linked state, and projecting at least a part of said plural linear portions.

* * * * *

UNITED STATES PATENT AND TRADEMARK OFFICE

CERTIFICATE OF CORRECTION

PATENT NO. : 6,369,777 B1
DATED : April 9, 2002
INVENTOR(S) : Ohara et al.

It is certified that error appears in the above-identified patent and that said Letters Patent is hereby corrected as shown below:

Column 13,
Line 41, “may e projected,” should read -- may be projected, --.

Signed and Sealed this

Eleventh Day of February, 2003

JAMES E. ROGAN
*Director of the United States Patent and Trademark Office*